US006591573B2

(12) United States Patent
Houghton

(10) Patent No.: US 6,591,573 B2
(45) Date of Patent: Jul. 15, 2003

(54) GUSSET PLATES CONNECTION OF BEAM TO COLUMN

(76) Inventor: David L. Houghton, 4500 E. Pacific Coast Hwy., Suite 100, Long Beach, CA (US) 90804

( * ) Notice: Subject to any disclaimer, the term of this patent is extended or adjusted under 35 U.S.C. 154(b) by 0 days.

(21) Appl. No.: 09/905,206

(22) Filed: Jul. 12, 2001

(65) Prior Publication Data

US 2003/0009977 A1 Jan. 16, 2003

(51) Int. Cl.[7] ..... E04C 2/38
(52) U.S. Cl. ..... 52/656.9; 52/236.3; 52/655.1
(58) Field of Search ..... 52/656.9, 92.1, 52/93.1, 653.1, 732.2, 736.2, 655.1 E, 236.3 R

(56) References Cited

U.S. PATENT DOCUMENTS

| | | | | | |
|---|---|---|---|---|---|
| 574,434 | A | | 1/1897 | Keithley | |
| 1,899,799 | A | * | 2/1933 | Edwards | 403/188 |
| 1,970,965 | A | * | 8/1934 | Leake | 403/188 |
| 2,720,291 | A | * | 10/1955 | Larkin | 403/169 |
| 3,716,959 | A | * | 2/1973 | Bernardi | 52/729.1 |
| 3,861,107 | A | * | 1/1975 | Papayoti | 52/655.1 |
| 3,938,297 | A | * | 2/1976 | Sato et al. | 403/188 |
| 4,220,419 | A | * | 9/1980 | Hawes | 403/189 |
| 4,476,662 | A | | 10/1984 | Fisher | |
| 4,648,216 | A | | 3/1987 | Reaves et al. | |
| 5,148,642 | A | | 9/1992 | Plumier et al. | |
| 5,577,353 | A | | 11/1996 | Simpson | |
| 5,595,040 | A | * | 1/1997 | Chen | 52/729.1 |
| 5,628,156 | A | | 5/1997 | Tarics | |
| 5,660,017 | A | | 8/1997 | Houghton | |
| 5,680,738 | A | | 10/1997 | Allen et al. | |
| 5,802,782 | A | | 9/1998 | Jewell | |
| 5,806,265 | A | | 9/1998 | Sluiter | |
| 6,138,427 | A | * | 10/2000 | Houghton | 52/655.1 |
| 6,237,303 | B1 | * | 5/2001 | Allen et al. | 52/729.1 |

FOREIGN PATENT DOCUMENTS

| | | |
|---|---|---|
| CA | 771849 | 11/1967 |

* cited by examiner

*Primary Examiner*—Anita King
(74) *Attorney, Agent, or Firm*—L. Lee Humphries

(57) ABSTRACT

This invention relates to columnar, "primary support" for a building or other heavy structure, in which a beam is connected to a column in a strong, moment-resisting connection comprised of two gusset plates welded to a flange or the face of the flange of the column and welded to the beam or attached to cover plates fixedly attached to the beam.

21 Claims, 13 Drawing Sheets

GUSSET PLATES CONNECTION OF BEAM TO COLUMN

This invention is related to U.S. Pat. No. 5,660,017, entitled Steel Moment Resisting Frame Beam-To-Column Connections, issued Aug. 26, 1997, U.S. Pat. No. 6,138,427, entitled Moment Resisting, Beam-To-Column Connection, issued Oct. 31, 2000 and a pending patent application Ser. No. 09/280,136 for Gusset Plate Connections For Structural Braced Systems. I am the sole inventor in all of such cases.

BACKGROUND OF THE INVENTION

It has been found in a moment-resisting building having a structural steel framework, that most of the energy of an earthquake, or other extreme loading condition, is absorbed and dissipated, in or near the beam-to-column joints of the building.

In the structural steel construction of moment-resisting buildings, towers, and similar structures, most commonly in the past, the flanges of beams were welded to the face of columns by full-penetration, single bevel, groove welds. Thus, the joint connection was comprised of highly-restrained welds connecting a beam between successive columns. Vertical loads, that is, the weight of the floors and loads superimposed on the floors, were and still are assumed by many to be carried by vertical shear tabs or pairs of vertical, structural angle irons arranged back-to-back, bolted or welded to the flange of the beam and bolted or welded to the face of the column.

In the prior art, the greater part of the vertical load placed upon a beam was commonly assumed to carried by a shear tab bolted or welded to the web of the beam and bolted or welded to the face of the flange of the column at each end of the beam. Through the use of face-to-face gusset plates welded to the beam and, also, welded to the column, the greater part of the vertical load is carried by the gusset plates, rather than by the shear tab.

Experience has shown that the practice of welding the beam's flanges directly to the column is uncertain and/or unsuitable for resistance to earthquakes, explosions, tornadoes and other disastrous events. Such connection means and welding practice has resulted in sudden, fractured welds, the pulling of divots from the face of the column flange, cracks in the column flange and column web, and various other failures.

Such highly-restrained welds do not provide a reliable mechanism for dissipation of earthquake energy, or other large forces, and can lead to brittle fracture of the weld and the column, particularly the flange of the column and the web of the column in the locality of the beam-to-column joint, (known as the "panel zone").

It is desirable to achieve greater strength, ductility and joint rotational capacity in beam-to-column connections in order to make buildings less vulnerable to disastrous events.

In the case of earthquakes, greater connection strength, ductility and joint rotational capacity are particularly desirable in resisting sizeable moments in both the lateral and the vertical plane. That is, the beam-to-column moment-resisting connections in a steel frame building, in an earthquake, are subjected to large rotational demands in the vertical plane due to interstory lateral building drift.

Engineering analysis, design and full-scale specimen testing have determined that prior steel frame connection techniques can be substantially improved by strengthening the beam-to-column connection in a way which better resists and withstands the sizeable beam-to-column, joint rotations which are placed upon the beam and the column.

That is, the beam-to-column connection must be a strong and ductile, moment-resisting connection.

Reference is made hereby to my U.S. Pat. Nos. 5,660,017 and 6,138,427, and my pending patent application Ser. No. 09/280,136, all mentioned above, for further discussion of prior practice and the improvement of the structural connection between beam and column through the use of gusset plates. Such patents and patent application are included herein by reference. U.S. Pat. No. 5,660,017 teaches the use of gusset plates extending alongside the column and the beam. U.S. Pat. No. 6,138,427 teaches the use of angle irons with gusset plates, to connect to column and/or beam. My patent application Ser. No. 09/280,136 teaches the use of braces with gusset plates connecting column to beam and brace.

SUMMARY OF THE INVENTION

This invention comprises the use of two gusset plates to attach a beam to a column, to serve as a "primary support" structure of a building, tower or similarly heavy structure. That is, the column is adapted for use as a permanent, columnar, structural support for carrying a load of the magnitude of building columnar loads or similarly heavy structural loads.

The structural joint of the invention comprises a column, (which may be a wide-flange column, a box column, a tube column or other suitable column), a beam (which may be a wide-flange beam, a box beam, a tube beam or other suitable beam) and a pair of gusset plates. It is to be understood that a box column has two flanges and two webs, as does a box beam. A tube column is closely similar to a box column, but has rounded corners. Similarly, a tube beam is closely similar to a box beam, but has rounded corners.

Although there are other structural shapes, (they are referred to as "S" shapes, "M" shapes, "HP" shapes, "narrow-flange" shapes and even others), that may be used as columns and beams, in the steel frame industry, customary design utilizes wide-flange columns and beams because of their having substantially greater strength, stiffness, compactness and/or depth range than do other available structural shapes. "Compactness" is determined by the ratio of the width of a flange to its thickness.

As to the column and beam shapes, the "W" shape is the one commonly used and is the shape used herein. It is known as the "wide-flange" shape. Other shapes are available and might be found suitable in certain designs, such as the "S" shape, "M" shape, "HP" shapes and even others.

The gusset plates in this invention face each other and extend from the column along opposing sides of the beam. One end of each gusset plate is welded to the flange of the column. In turn, the gusset plates are fixed with respect to the beam. In a preferred embodiment, the gusset plates are welded directly to the beam or welded to cover plates which are, in turn, attached to the beam by welds or fasteners.

The welds herein between the gusset plates and other members of the structural connection may be fillet welds, full-penetration groove welds, partial-penetration groove welds, flare-bevel groove welds or any other suitable weld which may be made by shielded metal arc welding, flux cored arc welding, electroslag welding, submerged arc welding or made by any other suitable welding technique within the requirements determined by a design engineer skilled in the art.

Commonly, groove welds between two structural elements entail one of the elements being beveled along its edge to be welded. The welds and techniques mentioned above are those commonly known as suitable welds and techniques in structural steel design. However, if additional suitable welds or weld types or techniques are available or become available, it is intended to cover such weld types or techniques as alternatives to the welds shown or discussed herein.

The mention or illustration of a particular kind of weld or particular kinds of welds, in the examples shown and discussed herein, is not intended to exclude the possible use of other kinds of welds which a skilled structural engineer would find suitable.

Full-penetration groove welds extend the full thickness of the element being welded. Partial-penetration groove welds customarily extend to half the thickness of the element being welded to ¾ths the thickness of the element being welded, although the amount of partial-penetration may be less or more than these amounts, within the requirements determined by a design engineer skilled in the art. The element being welded is usually suitably beveled so as to provide space for the weld.

This invention increases both the lateral and vertical, load-carrying stability and capability of the steel frame structure. The invention herein provides such capability, providing both a lateral and vertical load moment-resisting connection and increased vertical load-carrying capability. Further, this invention complies with the industry's current steel moment-resisting frame guidelines contained in Federal Emergency Management Agency (FEMA) guidelines (FEMA publications 350 and 351).

Consequently, the improved design of the invention is capable of carrying greater loads and capable of withstanding greater earthquakes and other calamities which may place extreme strain on a structure.

The beam-to-column connection invention herein may be made in the shop under controlled conditions and placed in new constructions or constructed in the field for new or retrofit constructions. Shop fabrication provides for better quality construction of a beam-to-column connection by reason of better control of the welding process and easier access to and handling of all parts of the connection. The invention effectively makes use of fillet welds, as well as full-penetration, partial-penetration groove welds, flare-bevel groove welds and any other suitable welds, all of which are better made under shop conditions, although they can suitably be made in the field, at greater expense and likely with less quality. Beam splices can be used in the field for erection purposes. Such splice connections when used are commonly located at structural points of reduced flexural stress. That is, the splice connections are located at some distance from the beam-to-column connection.

In some instances, bolting and angle irons may be used to connect beams to gusset plates. The word "fasteners" means herein "bolts" or "rivets". "Fastened" means attached by means of "fasteners". "Attached" means "welded", "bolted" or "riveted".

Structural steel buildings can also be constructed using a beam length which extends from one column to the next, without having to splice beam sections together. It is common to use long column sections, requiring fewer splices in the column.

The structural elements in my invention are likely to be made from steel known as ASTM A 572, Grade 50 or ASTM A 992 structural steel specification, except for the bolts and washers. High-strength aluminum and other high-strength metals and alloys might be found suitable under some circumstances.

It is to be appreciated that more than one beam may be connected to a column. For example, one beam could be connected on one side of a column and another beam could be connected on the opposing side of the column. Also, beams may be connected on four sides of a column in a biaxial application. That is, if, for example, the column is a box column, a joint connection to a respective beam could be made to each of potentially four flanges of the box column. In such case, there would be four beams, one extending in each direction away from the column. Another example of a biaxial application is a built-up cruciform column, (a multi-flanged column having as many as four flanges), wherein a joint connection to a respective beam could be made to as many as each of the flanges of the cruciform column. One example is a corner, two-sided beam-to-column connection comprising two mutually orthogonal column flanges. Another example is a three-sided beam-to-column connection comprising three column flanges. Still another example is a four-sided beam-to-column connection comprising all four column flanges.

It is to be realized in the discussion of the drawings and in the specification and claims that elements described as "horizontal" and "vertical" are with respect to the drawings as shown and such elements may be disposed at other angles and orientations depending on the construction of the structure involved. At times, columns are disposed at other than purely vertical angles and the elements would then also be at other than purely "horizontal" and "vertical" angles.

It is, therefore, an object of this invention to provide an improved structural joint connection between a beam and a column, through the use of gusset plates.

It is another object of this invention to provide an improved structural joint connection between a beam and a column through the use of gusset plates extending from the column along the sides of the beam.

Still another object of this invention is to provide an improved structural joint connection through the use of fillet welds, full-penetration welds, partial-penetration groove welds, flare-bevel groove welds or any other suitable weld between gusset plates and column.

And another object of this invention is to provide fixed attachment between two gusset plates and a column, by welding the vertical edge of each gusset plate, (the gusset plate edge parallel to the longitudinal axis of the column), to a flange of the column.

DETAILED DESCRIPTION

Figure 1:
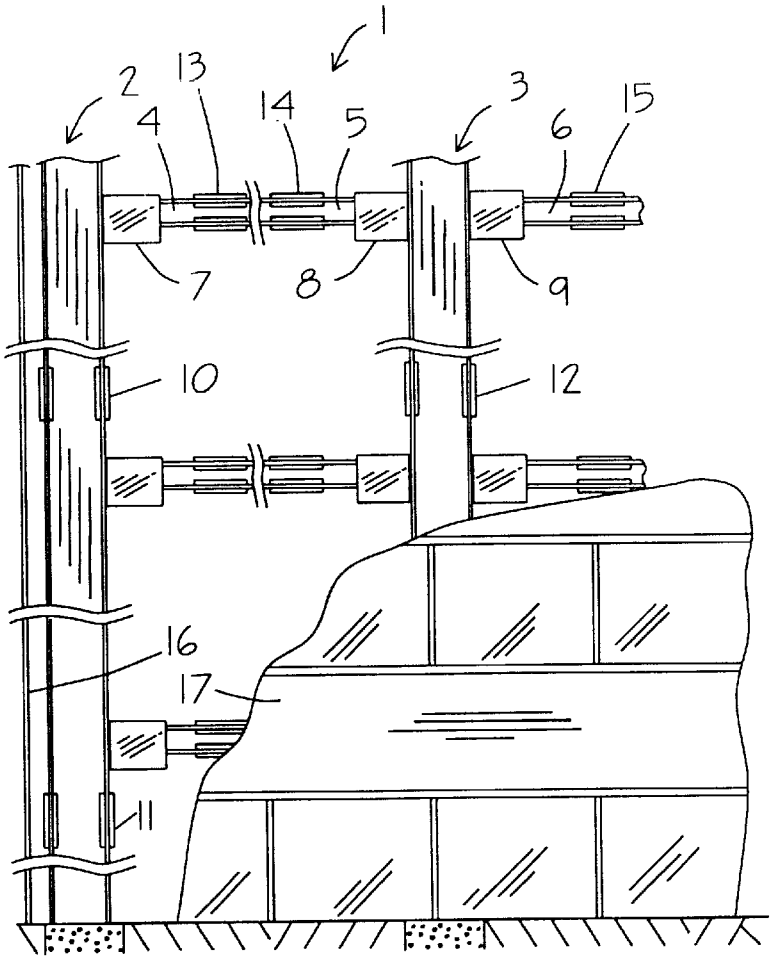
FIG. 1 is an elevation view of a structure utilizing the invention for each beam-to-column connection, illustrating the gusset plates attaching beams to columns, in strong, moment-resisting connections.

Referring to FIG. 1, there is shown the framework 1 for a moment-resisting building, tower or other structure requiring "primary support" structure. Such "primary support" structure is comprised of columns 2 and 3 and beam sections 4, 5 and 6 and the like. The beam sections 4, 5 and 6 are connected to the columns 2 and 3 through the use of gusset plates 7, 8 and 9. Columns 2 and 3 are spliced together through the use of splice plates 10, 11 and 12, or, alternatively, spliced through full-penetration or partial-penetration groove welds or any other suitable welds. Beam sections 4, 5 and 6 may be spliced together, as shown, through the use of splice plates 13, 14 and 15, or, alternatively, they may be spliced using full-penetration or partial-penetration groove welds or any other suitable welds.

Of course, a single long beam may be used in place of spliced beam sections. So, too, the columns may be constructed in long sections.

Curtain wall 16, shown in elevation, and curtain wall 17, shown in breakaway, provide exterior cover and are attached to the framework in a manner known to those skilled in the art.

Figure 2:
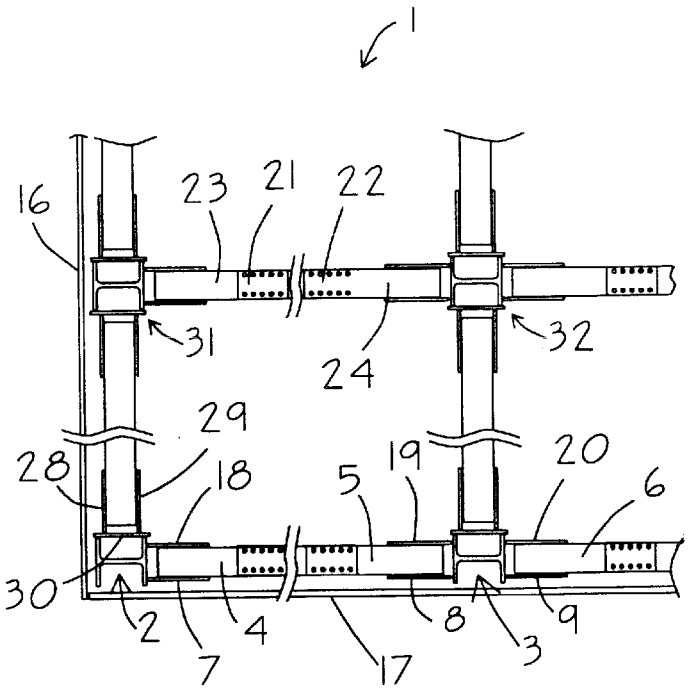
FIG. 2 is a plan view of the structure of FIG. 1, showing the gusset plates attaching beams to the columns.

FIG. 2 is a plan view of the structure of FIG. 1, showing the gusset plates 7 and 18 attaching beam section 4 to column 2. Likewise, gusset plates 8 and 19 connect beam section 5 to column 3 and gusset plates 9 and 20 connect beam section 6 to column 3. Splice plates 21 and 22 can be seen to splice together beam sections 23 and 24. It can be seen that column 2 has gusset plates 7 and 18 connected to the face of the flange of column 2 and, also, gusset plates 28 and 29 are connected to a plate 30 connected between the flanges of column 2.

In FIG. 2, it is noted that column connection may be made to only one beam, (not shown), to two beams as shown at column 2 in a corner two-sided connection, three beam sections, as shown at column 31 or four beam sections, as shown at column 32. Various combinations are possible.

Figure 3:
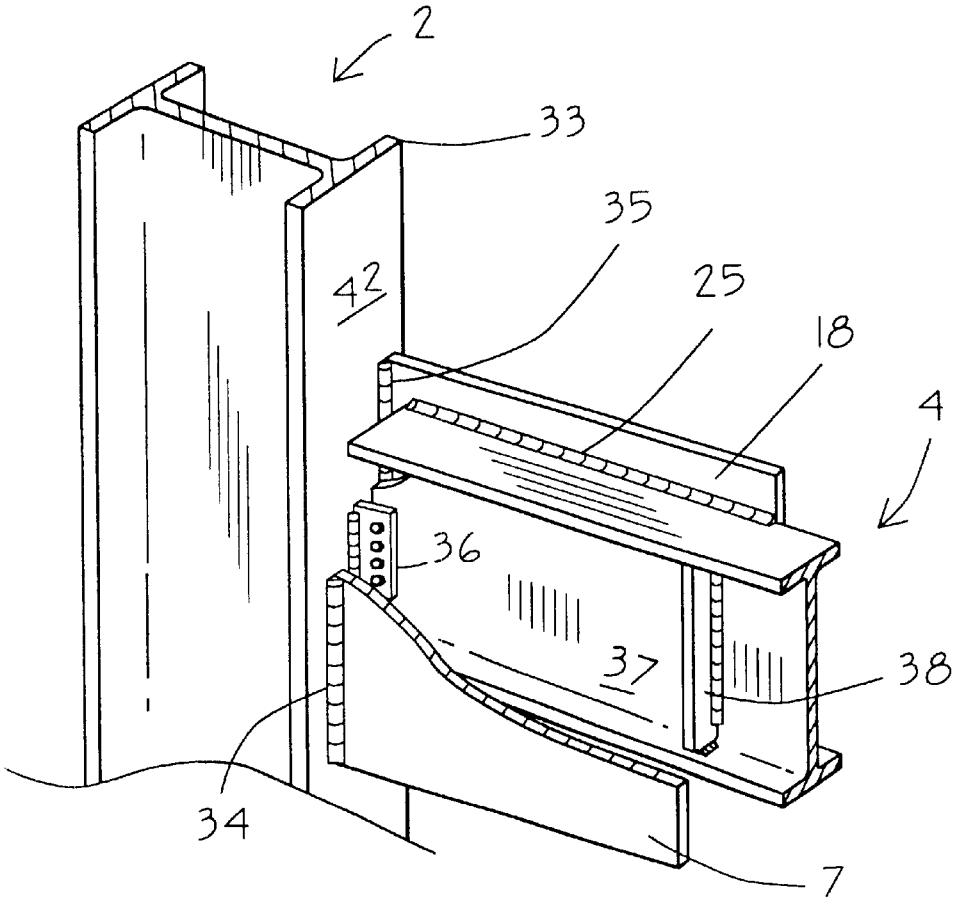
FIG. 3 is an isometric, with the near gusset plate in breakaway, illustrating in greater detail gusset plates attaching a beam to the face of a flange of a wide-flange column, including fillet welds between the gusset plates and the column flange and fillet welds between the gusset plates and the beam. Also illustrated are an optional shear tab attaching the beam web to the column flange and one of the vertical shear plates welded between the beam and the gusset plates.

FIG. 3 is an isometric drawing, with the near gusset plate 7, shown in breakaway, illustrating in greater detail gusset plates 7 and 18 attaching a beam 4, which may be a beam or a beam section, to the face 42 of a flange 33 of a wide-flange column 2. Gusset plate 7 can be seen to be on the near side of beam 4 and gusset plate 18 can be seen to be on the far side of beam 4. It can be seen that beam 4 ends before reaching the face 42 of flange 33 of column 2. Beam 4 is seen to have an upper and lower flange connected to each other by a web.

Gusset plates 7 and 18 each have a vertical edge, parallel to the longitudinal axis of the column 2, which vertical edge abuts the flange 33 of column 2. It is noted that the gusset plates 7 and 18 extend along beam 4, in the longitudinal direction of the beam, and, further, may extend above and below beam 4, as shown in this embodiment. Fillet welds 34 and 35, (which are visible, in FIG. 3), and 39 and 40, (which are hidden in FIG. 3, but visible in FIG. 4), attach gusset plates 7 and 18 to the face 42 of flange 33 of column 2. Fillet welds, such as longitudinal fillet weld 25, attach gusset plates 7 and 18 to beam 4. Alternatively, of course, such fillet welds may be, instead, full-penetration groove welds, partial-penetration groove welds or any other suitable welds.

It is significant that the welds connecting the gusset plates and the beam lie along the longitudinal direction of the beam. This creates a strong, moment-resisting connection between the gusset plates and the beam.

Also illustrated is an optional shear tab 36 attaching the beam web 37 to the column flange 33. Vertical shear plate 38 is welded between beam 4 and broken away gusset plate 7. Such vertical shear plate 38, in a preferred embodiment, is located approximately 1 inch from the end of the gusset plate 7. A corresponding vertical shear plate (not shown) is similarly located on the opposite side of web 37, welded to that opposite side of the web of beam 4 and to gusset plate 18.

An example of a beam, or, more accurately, a beam section, might be one that is 15⅞ inches wide, 40⅛ inches deep, and a span length of 29 feet, having a web 1 inch thick and flanges 1 13/16 inches thick and weighing 324 lbs. per lineal foot. An example of a corresponding column might be one that is a built-up box column that is 24 inches wide, 24 inches deep and is comprised of two flange plates 4 inches thick and two web plates that are 2½ inches thick, spanning vertically between floors with a story height of 20 feet or more. The gusset plates might extend beyond the face of the column flange by 34 inches and be 54 inches deep and 2 inches thick.

Figure 4:
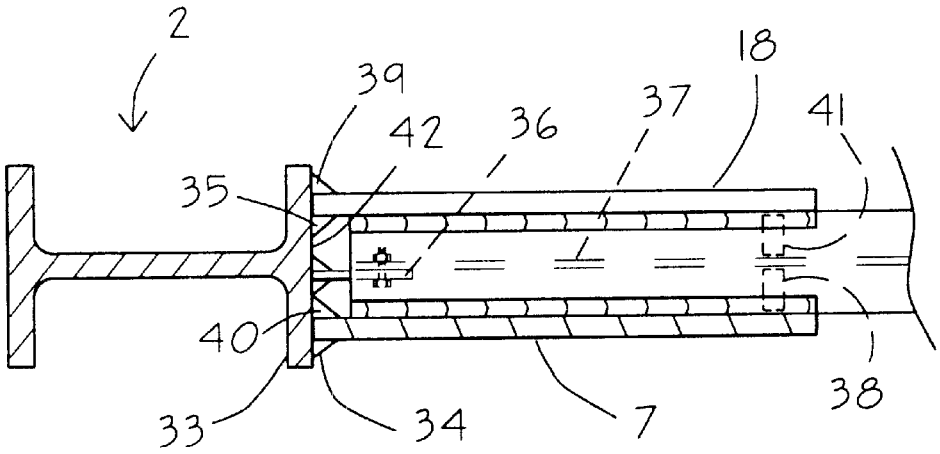
FIG. 4 is a plan view of FIG. 3, showing the column in cross-section.

FIG. 4 is a plan view of FIG. 3, showing the column 2 in cross-section and more clearly showing the fillet welds 34, 35, 39 and 40, connecting gusset plates 7 and 18 and the flange 33 of column 2. Alternatively, fillet welds 34, 35, 39 and 40 may be full-penetration groove welds, partial-penetration, or any other suitable welds. Also shown are optional shear tab 36 (partially in hidden lines) and (in hidden lines) web 37 and vertical shear plates 38 and 41. Such vertical shear plates are located near or at the end of such gusset plates.

Vertical shear plates are quite essential, in the various joint connections herein, to transfer the vertical load placed on the beam, to the gusset plates and, thence, to the column. Further, such vertical shear plates assist in making the joint connection, a strong, moment-connection, resisting excessive moments and loads, particularly those caused by disastrous events.

Figure 5:
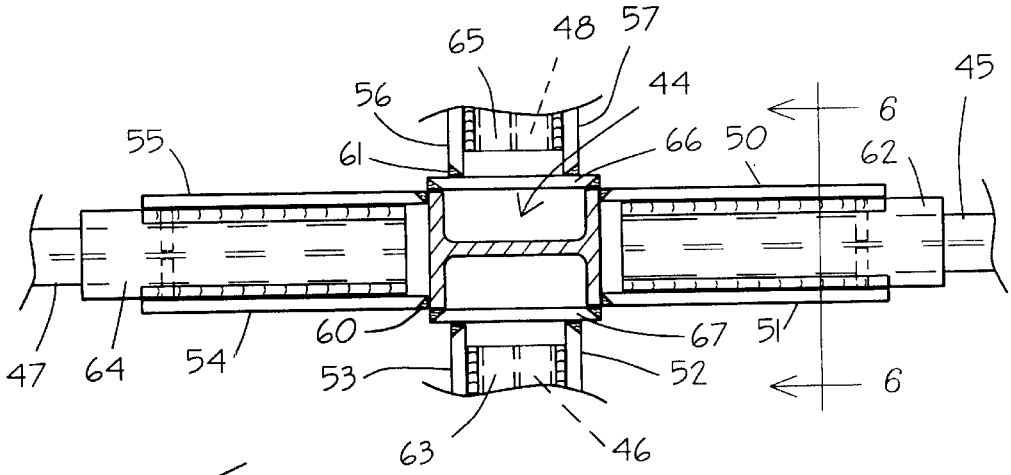
FIG. 5 is a plan view of a column, shown in cross section, illustrating beams connected to all four sides of the column, through the use of gusset plates, and full-penetration groove welds. The lateral beams are connected to vertical continuity stiffener plates oriented parallel to the column web. Such vertical continuity stiffener plates are welded to the flange tips of the column.

FIG. 5 is a plan view of a column 44, shown in cross section, illustrating beams 45, 46, 47 and 48 connected to the four sides of column 44, through the use of gusset plates 50–57. It is noted that the beams 45–48 are not as wide as the space between the gusset plates 50–57, consequently cover plates 62–65 are used to bridge the gap.

Transverse beams 46 and 48, are hidden under cover plates 63 and 65, respectively. It can be seen that the gusset plates are all attached at their ends by full-penetration groove welds, for example, welds 60 and 61. Alternatively, such groove welds may be fillet welds disposed on both sides of gusset plates 50–57, partial-penetration groove welds or any other suitable welds. The lateral beams 46 and 48 are fixedly attached through cover plates 63 and 65 to gusset plates 52 and 53 and to gusset plates 56 and 57, which are, in turn, welded to vertical, stiffener continuity gusset plates 66 and 67, respectively, by full-penetration groove welds. Gusset plates 66 and 67 are themselves welded, at their ends, to the ends of flanges of column 44, by full-penetration groove welds. The edges, or ends, of gusset plates 50–57 are all beveled in order to provide a welding surface for making the full-penetration groove welds. Gusset plates 66 and 67 extend in the longitudinal direction of the column approximately the same depth as gusset plates 52, 53, 56 and 57.

Figure 6:
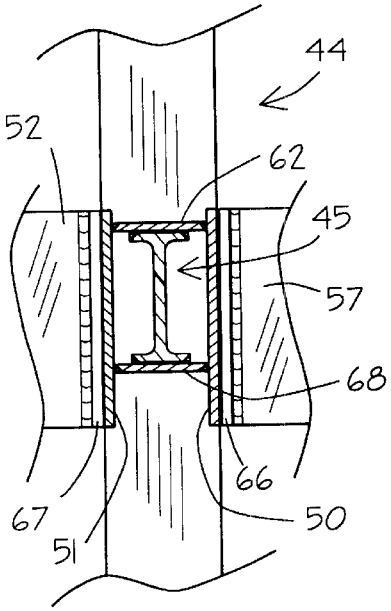
FIG. 6 is a sectional view taken on line 6—6, FIG. 5, showing cover plates attached to the beam and to the gusset plates using full-penetration groove welds.

FIG. 6 is a sectional view taken on line 6—6, FIG. 5, showing top cover plate 62 and bottom cover plate 68 attached to the beam 45, bridging the gap between gusset plates 50 and 51. Connections between beam flanges, cover plates and gusset plates are shown as full-penetration groove welds, which may alternatively be partial-penetration groove welds, fillet welds or any other suitable welds. Vertical, stiffener continuity gusset plates 66 and 67 are shown in end view, located between and welded to the ends of the flanges of column 44 and gusset plates 57 and 52. In many constructions, partial-penetration groove welds, fillet welds or any other suitable welds may be used to make some or all of such connections.

Figure 7:
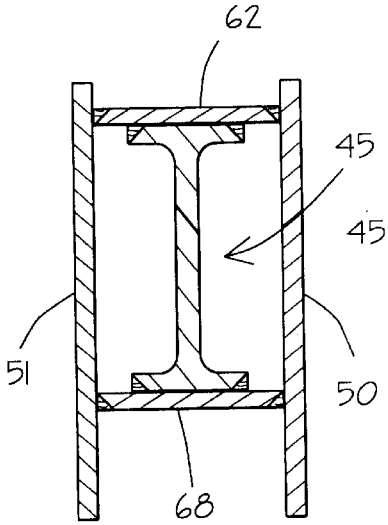
FIG. 7 is an enlarged view of the beam of FIG. 6, showing the full-penetration groove welds in greater detail.

FIG. 7 is an enlarged view of the beam 45 of FIG. 6, showing the full-penetration welds in greater detail, between beam 45 and top and bottom cover plates 62 and 68. Such cover plates are shown similarly welded to gusset plates 50 and 51.

Figure 7A:
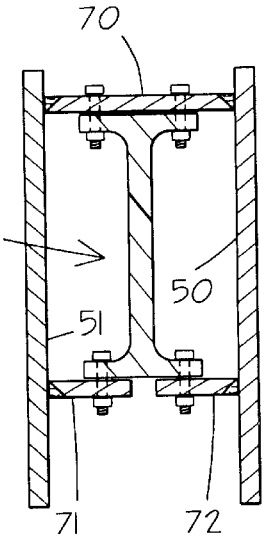
FIG. 7A illustrates connecting the cover plate to the flange of the beam by bolts.

FIG. 7A illustrates a similar situation to FIG. 7, in which the cover plates 60, 61 and 62 are bolted, instead of welded, to beam 45. Such cover plates are, in turn, welded to the gusset plates 50 and 51. It is noted that on the bottom of beam 45 there are two cover plates 71 and 72 instead of a single cover plate as cover plate 70. This is merely to show an alternative to a single cover plate. Although it is possible to use this combination of top and bottom cover plates, it is not likely. More likely the bottom cover plate or plates will be the same as the top cover plate or plates.

Figure 8:
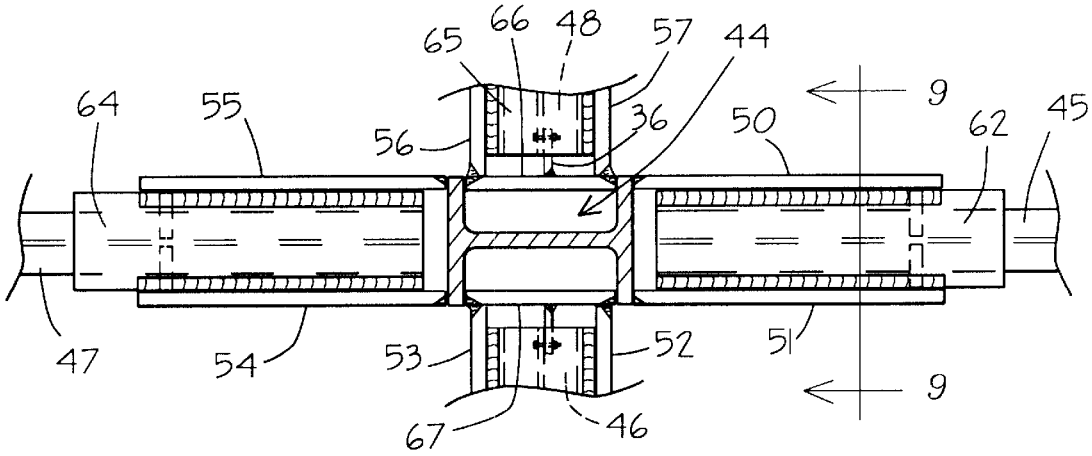
FIG. 8, similar to FIG. 5, is a plan view of a column, shown in cross-section, illustrating beams connected to all four sides of a column, through the use of gusset plates and attaching the beam to the gusset plates using partial-penetration welds. The lateral beams are connected to vertical, continuity stiffener plates which are flush with the column's flange tips.

FIG. 8, similar to FIG. 5, is a plan view of a column 44, shown in cross-section, illustrating beams 45 and 47 fixed with respect to column 44 by means of cover plates 62 and 64. The beams 45 and 47 are attached to cover plates 62 and 64 by welding, but may be attached by bolting or riveting. The cover plates are, in turn, attached to the gusset plates 50, 51, 54 and 55, preferably, by fillet welds, but, alternatively, by full-penetration groove welds, partial-penetration groove welds or any other suitable welds. Two additional beams are similarly connected perpendicularly to the web of the column 44. For example, it can be seen that transverse beam 48 is hidden under cover plate 65.

In distinction to FIG. 5, vertical, stiffener continuity gusset plates 66 and 67 are disposed within column 44, being flush with the flanges of the column 44. It is noted they are also flush with gusset plates 50, 51, 54 and 55 and, so, also serve as "continuity plates", or "stiffener plates", strengthening column 44 at the location the gusset plates connect to the column.

In this embodiment, the flanges of the column 44 are not beveled, but the gusset plates 50–57 and gusset plates 66 and 67 are beveled, so as to allow them to be connected, as shown, at their ends, by partial-penetration groove welds. They could, of course, be beveled so as to be connected by full-penetration groove welds or by any other suitable welds.

Similar to the embodiment in FIG. 5, gusset plates 66 and 67 allow two additional beams, hidden beams 46 and 48, to be fixed with respect to the column 44. Thus, beams can be readily connected to all four sides of a column. Optional shear tab 36 is shown bolted to the web of hidden beam 48 and welded to gusset plate 66.

Figure 9:
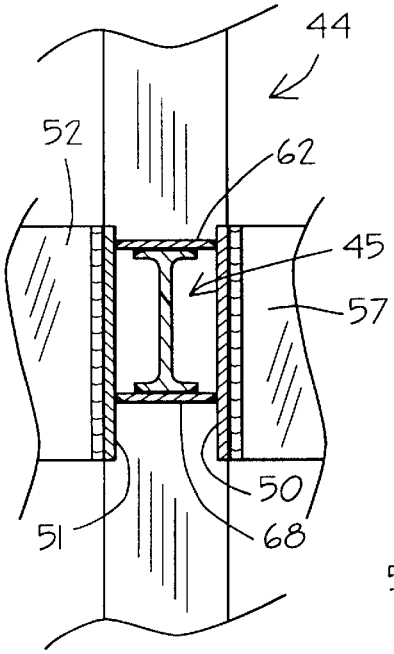
FIG. 9 is a sectional view taken on 9—9, FIG. 8, showing cover plates attached to the beam and gusset plates, using partial-penetration groove welds.

FIG. 9 is an elevation, sectional view taken on 9—9, FIG. 8, showing cover plates 62 and 68 attaching beam 45 with respect to gusset plates 50 and 51, using partial-penetration welds. Of course, alternatively, the other weld types mentioned herein may be used.

Figure 10:
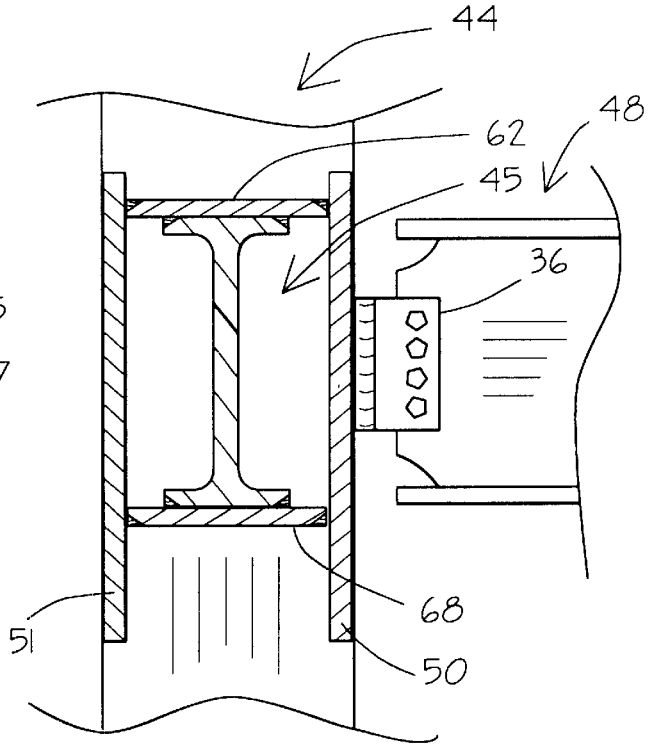
FIG. 10 is an enlarged view of FIG. 9 with the cover plates removed, showing an optional shear tab connection of the lateral beam.

FIG. 10 is an enlarged, partial view of FIG. 9 with the lateral gusset plates 52 and 57 removed, showing optional shear tab 36 connecting the web of a lateral beam 48 to the face of gusset plate 66, (not visible in FIG. 10, but shown in FIG. 8), which is welded to the flanges of column 44. It can be seen that the optional shear tab 36 is bolted to the web of beam 48 and welded to the face of gusset plate 66, (shown in FIG. 8). Shear tab 36 may, of course, be welded instead of bolted to the web, or riveted, instead of bolted to the web.

Figure 11:
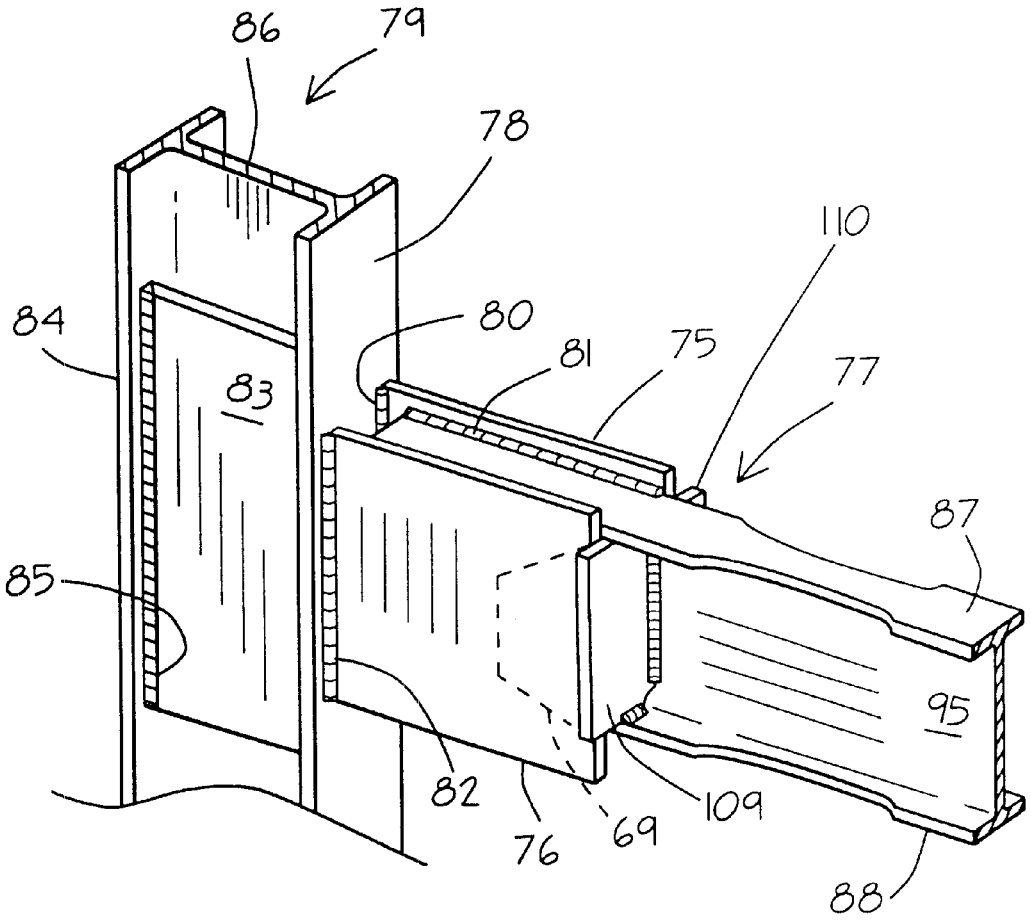
FIG. 11 is an isometric view of gusset plates connecting a beam to a column flange by fillet welds. An indented vertical, continuity stiffener plate, or doubler plate, is shown, strengthening the "panel zone" of the column. Also, the beam has flanges which are reduced in width for a short distance, which likely provides a structural fuse to soften the moment demand on the gusset plates, in certain designs.

FIG. 11 is an isometric view of gusset plates 75 and 76 connecting beam 77 to the flange 78 of column 79 by fillet welds, such as fillet welds 80, 81 and 82. An indented vertical, continuity stiffener plate 83, or doubler plate, is welded between flanges 78 and 84 of column 79, by full-penetration groove welds such as weld 85.

A corresponding vertical, continuity stiffener plate is similarly disposed on the other side of web 86 of column 79. Such continuity plates strengthen the "panel zone" of the column. The "panel zone" is the "zone" of the web of the column to which the beams are attached and, of course, the "zone" where the greatest stress is placed on the web of the column during extreme loading and overloading.

Also, the beam 77 has flanges 87 and 88 which are reduced in width for a short distance, creating a likely structural fuse in the beam to soften, or minimize moment demand on the gusset plates 75 and 76. The use of such reduced width in beams is well-known in the art.

While not so shown in the embodiment of FIG. 11, for original construction it is likely that vertical shear plates would be installed, internally, between beam 77 and gusset plates 75 and 76, similar to vertical shear plate 38 and its corresponding vertical shear plate 41 on the opposite side of the web 37 of beam 4, in FIGS. 3 and 4. However, for retrofit applications, as shown in the embodiment of FIG. 11, it is likely that the external vertical shear plate 109, including its counterpart 110 on the opposite side of beam web 95, would be located as shown, to accommodate the manufacture of gusset plates 75 and 76, each with a cutout, such as that shown by dotted lines 69, in plate 76, FIG. 11. Those cutouts permit access to make weld 80 and its counterpart weld on inside face of gusset plate 76. Such cutout is replaced by welding, after weld 80 and its counterpart weld have been made connecting the inside face of gusset plates 75 and 76 to the face of the flange 78 of column 79.

The welds of the continuity stiffener plate 83, (and its hidden counterpart), within column 79 could be fillet welds, full-penetration groove welds, partial-penetration groove welds or any other suitable weld. The welds between gusset plates 75 and 76 and the face 78 of column 79 would likely be full-penetration groove welds or other suitable weld which would provide maximum strength.

Figure 12:
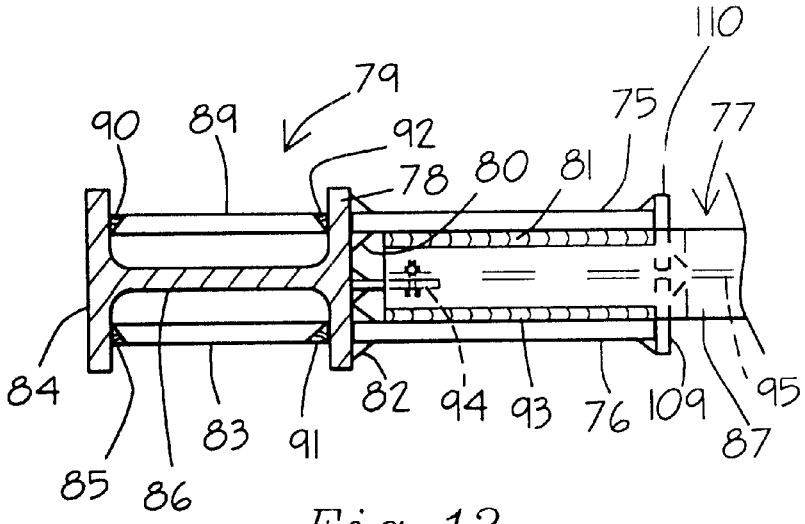
FIG. 12 is a plan view of FIG. 11, with the column in section, showing the indented vertical, continuity stiffener plates, welded by full-penetration groove welds to the column and the gusset plates fillet welded to the flange of the column and the beam flanges. An optional shear tab connects the beam web to the flange of the column.

FIG. 12 is a plan view of FIG. 11, with the column 79 shown in section, showing the indented vertical, continuity stiffener plates 83 and 89 welded to the column 79. Examples of full-penetration groove welding of vertical, continuity stiffener plates 83 and 89 are full-penetration groove welds 85, 90, 91 and 92. The gusset plates 75 and 76 are fillet welded to the flange 78 of the column 79 by fillet welds such as fillet welds 80 and 82. Gusset plates 75 and 76 are welded to the beam flanges by welds 81 and 93, which may be fillet welds, or, alternatively, partial-penetration groove welds, full-penetration groove welds or any other suitable welds. Optional shear tab 94, partially hidden, connects the beam web 95 to the flange 78 of the column 79. It may be seen that the gusset plates 75 and 76 connect directly to the beam 77, with no cover plates being involved. It may also be seen that the gusset plates 75 and 76 are disposed inwardly from the vertical edges of the flange 78 of column 79. Previously, in FIGS. 5 and 8, the gusset plates were disposed at the vertical edges of the flange of the column. Thus, alternative locations of the gusset plates, as to the face of the column, are possible, when designing the structural connection.

External vertical shear plates 109 and 110 are more clearly illustrated in FIG. 12, being fillet welded to gusset plates 76 and 75 and, also, to the web 95 of beam 77.

Figures 13, 14, 14A:
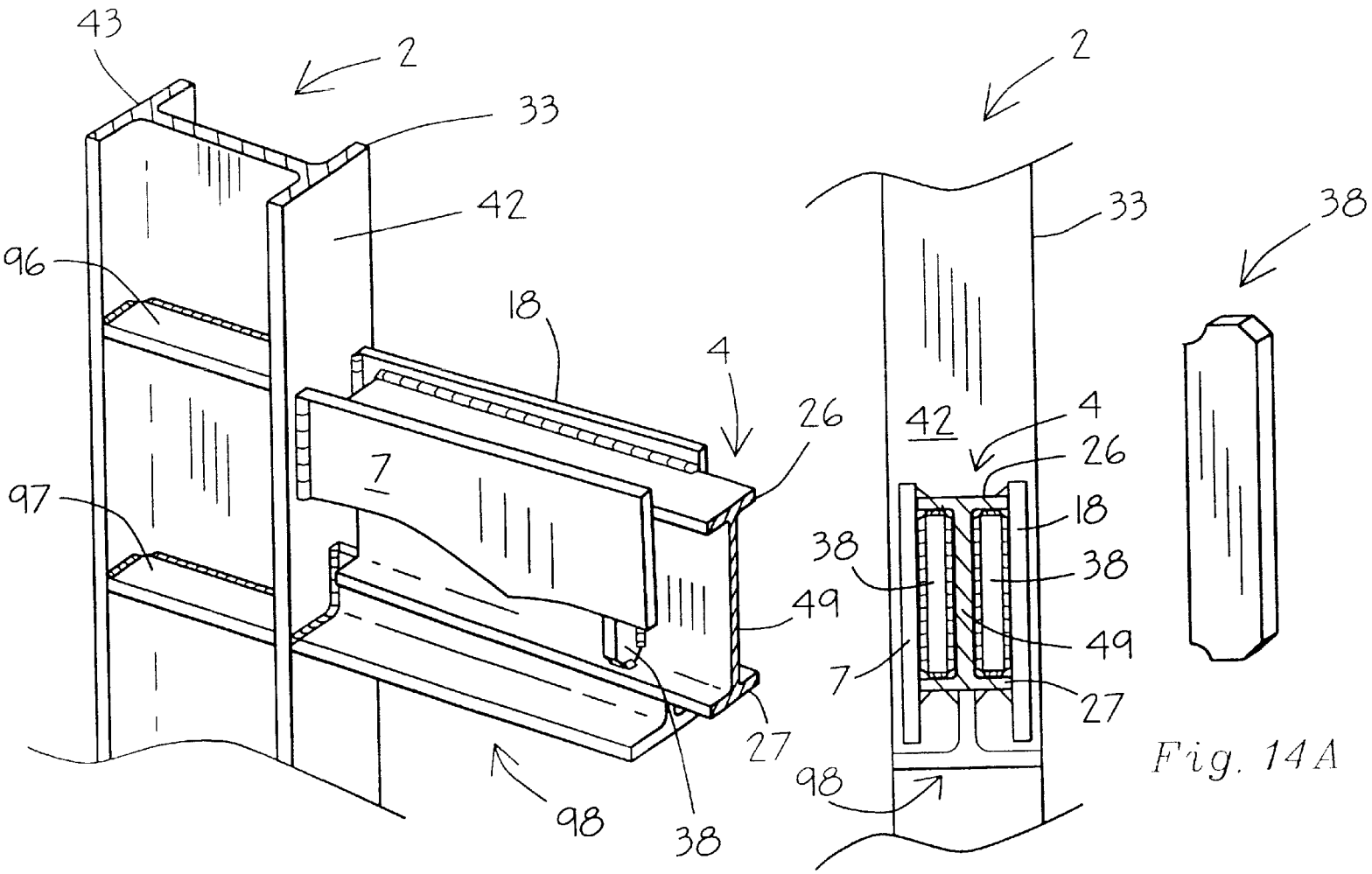
FIG. 13 is an isometric view of a fillet welded beam-to-column connection, showing the use of horizontal, continuity stiffener plates to strengthen the column flange and a fillet welded haunch is shown attached to the bottom flange of the beam and to the flange of the column.
FIG. 14 is an end view of a beam, shown in section, connected to a column, illustrating vertical shear plates welded to the beam and gusset plates.
FIG. 14A is an illustration of a vertical shear plate, showing its clipped and radiused corners.

FIG. 13 is an isometric view of a beam 4 connected to column 2 by gusset plates 7 (shown in break-away) and 18 which are fillet welded to the face 42 of flange 33. Such gusset plates are fillet welded to the top flange 26 and bottom flange 27 of beam 4. Top and bottom flanges 26 and 27 are connected to each other by web 49. Additional strengthening of the flanges of column 2 is achieved through the use of horizontal, continuity stiffener plates 96 and 97 welded inside the column. A haunch 98, under beam 4, is shown welded to the face 42 of the column flange 33 with a full-penetration groove weld and, also, welded to the bottom flange 27 of the beam 4, with either two fillet welds (one on each side of the haunch's web, as shown hereafter in FIG. 14), or with a full-penetration groove weld. Haunch 98 may be seen to be in the shape of an inverted "T". Haunch 98 strengthens the moment resistance of the connection between the beam 4 and column 2 and serves further to assist in carrying the vertical load placed on beam 4. Vertical shear plate 38 is welded between the beam 4 and gusset plate 7 to carry vertical loads placed upon the beam 4, and to transfer those loads through the gusset plate 7 to the column 2. A similar vertical shear plate is similarly disposed and welded on the opposite side of beam 4.

Of course, the alternative weld types mentioned hereinbefore may be used instead of those shown in FIGS. 9 through 13 and in the FIGS. discussed hereinafter.

FIG. 14 is an end view of the beam 4 of FIG. 13, shown in section, connected to column 2 at face 42 of its flange 33 by gusset plates 7 and 18 which can be seen to be fillet welded to the flanges of beam 4. Vertical shear plates 38 are welded to the web 49 and flanges 26 and 27 of beam 4 and, also, to gusset plates 7 and 18. Such vertical shear plates serve to transfer the vertical load placed on the beam 4, to the gusset plates 7 and 18 and, thence, to column 2. Preferably, such vertical shear plates are located near the end, or, even, at the end of the gusset plates 7 and 18. Haunch 98 may be seen to be welded to the bottom flange 27 of beam 4.

FIG. 14A is an illustration of a vertical shear plate 38, showing its surfaces which allow welding to the beam 4 and the gusset plates 7 and 18, FIGS. 13 an 14, and its clipped corners and radiused corners which keep the vertical shear plate 38 free of weld tie-in around its corners and around the corners created by the flange tips of beam 4 and the gusset plates 7 and 18.

Figure 15:
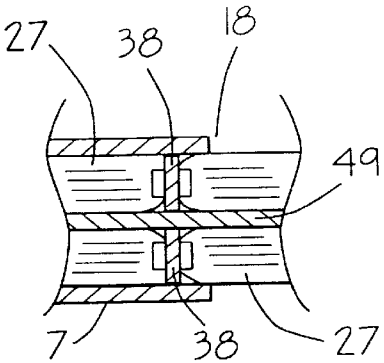
FIG. 15 is a plan illustration, in section, of vertical shear plates connecting the beam web and flanges to the gusset plates.

FIG. 15 is an plan illustration, in section, of vertical shear plates 38 fillet welded to the beam web 49 and to gusset plates 7 and 18. Vertical shear plates 38 are also fillet welded to the flanges of beam 4 of which only bottom flange 27 is visible.

Figure 16:
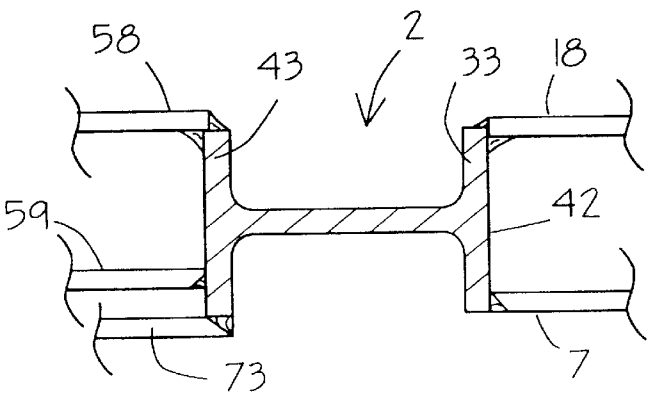
FIG. 16 is a cross-section, plan view of a column, in section, illustrating various possible connections of gusset plates to a column.

FIG. 16 is a cross-section, plan view of a column 2, illustrating various possible locations and weld connections of gusset plates to a column. These examples would not likely be used together but the same or similar connections would be used to connect to a column. It is noted that in each example, the gusset plate "abuts" a flange of the column 2. By "abuts" or "abutting" is meant "terminates at", "terminates up against", or "terminates adjacent to", as typified by the various examples shown in FIG. 16. Gusset plate 18 is shown disposed partially, slightly beyond the end of flange 33 of column 2 and fillet welded to such flange 33. Gusset plate 7 is shown full-penetration groove welded to the face of flange 33 of column 2. Gusset plate 58 is shown fillet welded on the end of flange 43 of column 2, although this weld configuration is not a preferred one. Gusset plate 59 is shown welded to the face of flange 43, inwardly of its end, by a partial-penetration groove weld. Gusset plate 73 is shown welded to the end of flange 43 of column 2 by a full-penetration groove weld. All of such locations and welds, in different combinations of weld and location, may be suitable in particular engineering designs. It is likely that a uniform location and weld would be used in connecting multiple gusset plates to a column.

Figure 17:
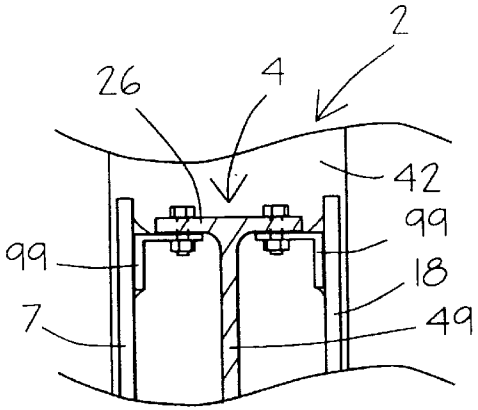
FIG. 17 shows the upper half of a beam, in section, connected by angle irons to gusset plates.

FIG. 17 shows the upper half of a beam 4, in section, connected by angle irons 99 which are shown fillet welded to gusset plates 7 and 18 and bolted to the top flange 26 of beam 4. Using angle irons in this and other ways, is taught in my U.S. Pat. No. 6,138,427.

Figure 18A:
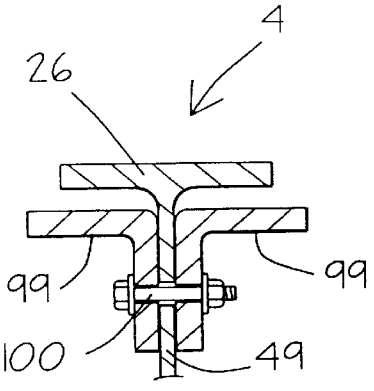
FIG. 18A illustrates the bolted connection of FIG. 18, between angle irons and the upper half of the beam which is shown in section. The angle irons are bolted through the web of the beam, to each other.
Figure 18:
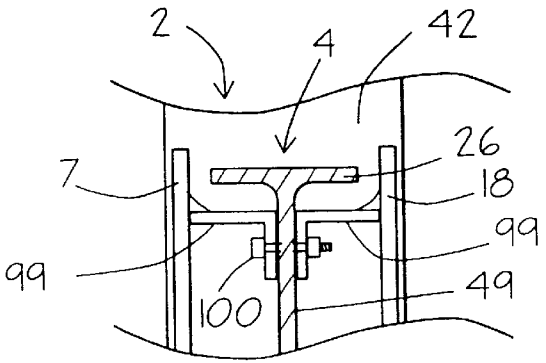
FIG. 18 shows the upper half of a beam, in section, connected by angle irons to gusset plates. The angle irons are disposed at a different location than those shown in FIG. 17.

FIG. 18 shows the upper half of beam 4, in section, connected by angle irons 99 to gusset plates 7 and 18. The angle irons 99 are disposed spaced apart from the top flange 26 of beam 4, a different location than shown in FIG. 17. Angle irons 99 are bolted together through the web 49 of beam 4, by bolt 100.

FIG. 18A more clearly illustrates the bolted connection of FIG. 18, between angle irons 99 and the upper half of beam 4 which is shown in section. The angle irons 99 are bolted through the web 49 of the beam 4, to each other. Further discussion of bolting may be found in my U.S. Pat. No. 6,138,427. High-strength bolts are customarily used in bolting practice. High-strength rivets may be suitably used in some circumstances. Angle irons are most conveniently used in retrofitting structural connections of haunched variable-section columns and beams used in pre-engineered moment-resisting steel frame buildings.

Figure 19B:
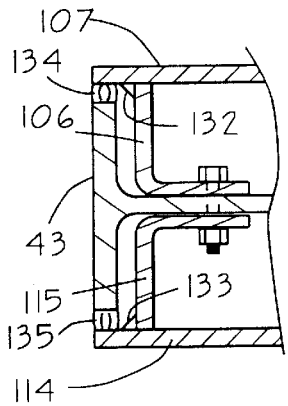
FIG. 19B is a partial, cross-section view taken on line 19B—19B, FIG. 19.
Figure 19:
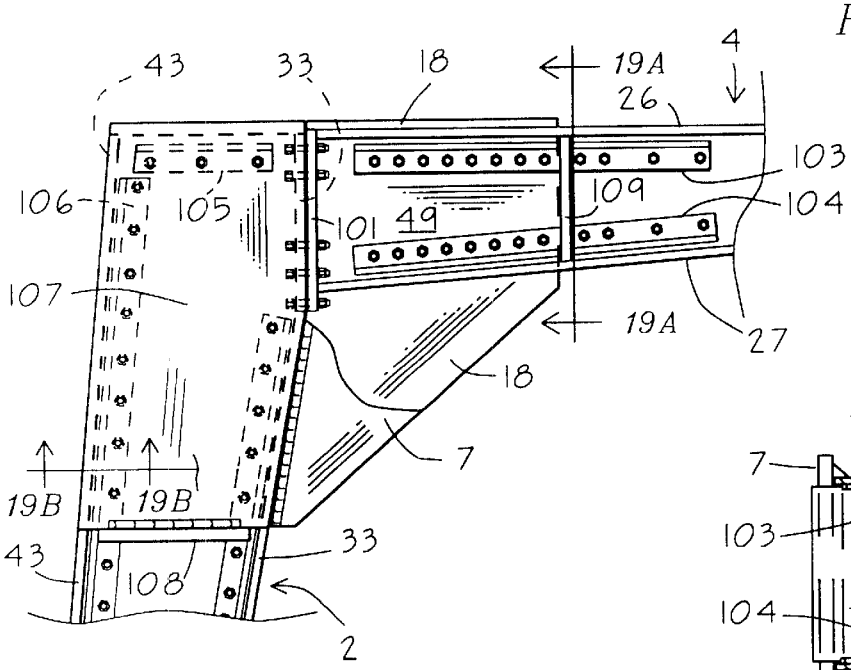
FIG. 19 illustrates a retrofit construction having a previously-constructed structural joint in which a beam has an endplate which is bolted to a column flange. Angle irons are bolted to both beam and column to strengthen them both. The angle irons are welded to the gusset plates. The near gusset plates are shown only partially, in break-away.

FIG. 19 illustrates a retrofit construction having a previously-constructed structural joint in which a beam 4 has an endplate 101 which is bolted to a column flange 33. Angle irons 103 and 104 are bolted to the web 49 of beam 4, and angle irons, such as 105 and 106, are bolted to column 2, to strengthen the connection. The angle irons 103 and 104 are welded to the gusset plate 7 (the near gusset plate shown only partially, in break-away). Similar angle irons are disposed oppositely angle irons 103 and 104, on the opposite side of the web 49 of beam 4 and those oppositely disposed angle irons are welded to distant gusset plate 18, on the far side of beam 4. It is noted that gusset plates 7 and 18, similar to prior FIGS., are welded to the flange 33 of column 2. Vertical, continuity stiffener plate 107 is welded to an edge of flange 33 of column 2 and to an edge of flange 43 of column 2. There is a similar vertical, continuity stiffener plate 114, (visible in FIGS. 19B and 20), on the far side of column 2, corresponding to vertical, continuity stiffener plate 107 on the near side of column 2. It can be seen that vertical, continuity stiffener plate 107 is welded to horizontal shear plate 108. Similar vertical, continuity stiffener plate 111, (not visible, but shown in FIG. 20), is welded to a similar horizontal shear plate disposed on the far side of column 2.

An external vertical shear plate 109 welded to the web 49 of beam 4 is also welded to the outside end of gusset plate 7. A similar vertical shear plate is disposed on the far side of web 49 of beam 4, welded between the web 49 of beam 4 and gusset plate 18.

Figure 19A:
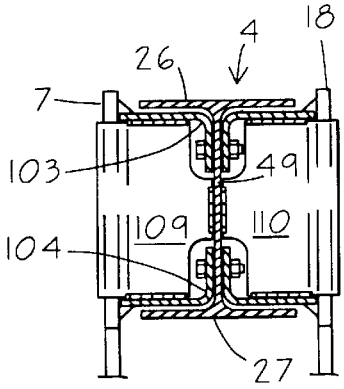
FIG. 19A is a cross-section taken on line 19A—19A of FIG. 19, showing the beam flanges and web, the angle irons, bolts, gusset plates and vertical shear plates welded to the web, the angle irons and the gusset plates.

FIG. 19A is a cross-section taken on line 19A—19A of FIG. 19, more clearly showing the top and bottom beam flanges 26 and 27 and web 49 therebetween, angle irons, such as angle irons 103 and 104, bolted to web 49. Also shown are gusset plates 7 and 18 and external vertical shear plates 109 and 110 welded to web 49 of beam 4 and angle irons such as angle irons 103 and 104. Of course, external vertical shear plates 109 and 110 are also welded by welds not visible in this view, to the gusset plates 7 and 18.

FIG. 19B is a partial, cross-section view taken on line 19B—19B, FIG. 19. The fillet weld 132 between the vertical, continuity stiffener plate 107 and the angle iron 106 would be made if accessible, and that would be followed by making weld 134 between the edge of flange 43 and vertical, continuity stiffener plate 107. If a fillet weld is not accessible and cannot be made, only the weld 134 between the vertical, continuity stiffener plate 107 and the edge of column flange 43 would be made. Likewise, if accessible, the fillet weld 133 between vertical, continuity stiffener plate 114 and angle iron 115 would be made, otherwise, only the weld 135 between the vertical, continuity stiffener plate 114 and the edge of column flange 43 would be made.

Figure 20:
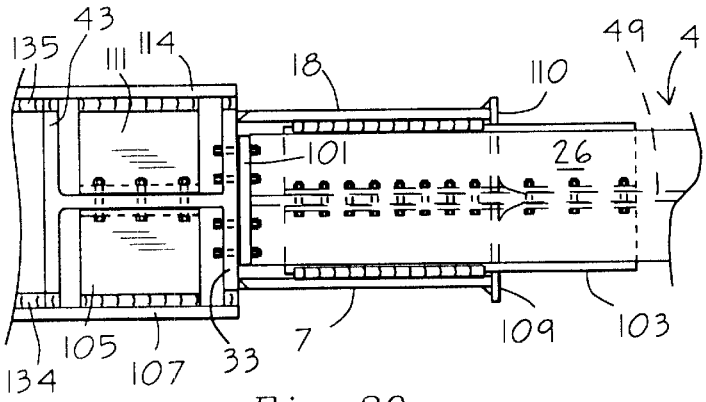
FIG. 20 is plan view of FIG. 19.

FIG. 20 is a plan view of FIG. 19, showing angle irons 105 and 111 which lie within the top of column 2. Looking down on top flange 26 of beam 4, it can be seen that external vertical shear plates 109 and 110 extend outwardly from the web 49, (shown in dotted lines), of beam 4 and are shown fillet welded to gusset plates 7 and 18. The angle irons, such as angle iron 103, are also welded to the gusset plates 7 and 18. Gusset plates 7 and 18 can also be seen, in this view, welded by full-penetration groove welds to the flange 33 of column 2. Vertical, continuity stiffener plates 107 and 114 can be seen to be welded to the edges of flanges 33 and 43, by welds 134 and 135. Such vertical, continuity stiffener plates are also shown welded by fillet welds to angle irons 105 and 111.

Figure 21:
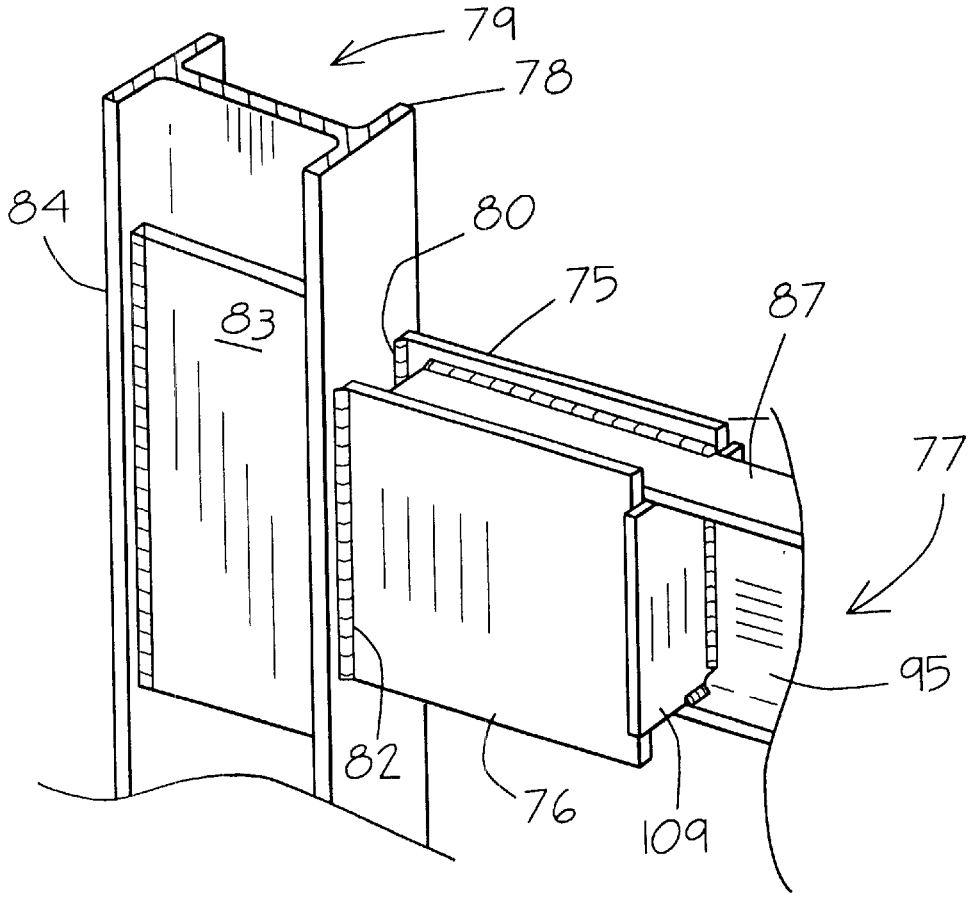
FIG. 21 is an isometric view of gusset plates welded to the face of a column flange, showing also a vertical shear plate disposed at the end of a gusset plate and a vertical, continuity stiffener plate disposed within the column.

FIG. 21 is an isometric view of gusset plates 75 and 76 fillet welded by fillet welds 80 and 82, to the face of flange 78 of column 79. Also shown are external vertical shear plate 109 disposed at the end of gusset plate 76 and a vertical, continuity stiffener plate 83 welded by full-penetration groove welds, within the column 79. An external vertical shear plate similar to 109 is disposed on the opposite side of beam web 95.

Figure 22:
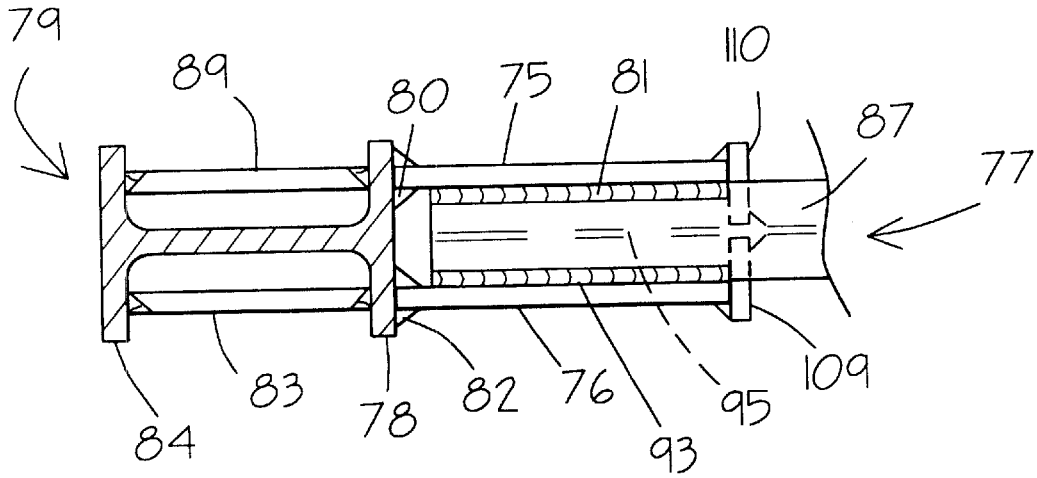
FIG. 22 is a plan view of FIG. 21 in which the welds between the gusset plates and the external vertical shear plates and the column are more clearly shown, as are the welds between the vertical, continuity stiffener plates and the column flanges.

FIG. 22 is a plan view of FIG. 21 in which the welds, such as fillet welds 81 and 93, between the gusset plates 75 and 76 and the flange 87 of beam 77 are more clearly illustrated. The external vertical shear plates 109 and 110 are more clearly shown welded by fillet welds to gusset plates 75 and 76. Of course, such external vertical shear plates are also welded to the beam web 95 and to the flanges of the beam 77. The gusset plates 75 and 76 are also welded to the face of flange 78 of column 79 by welds such as fillet welds 80 and 82. Vertical, continuity stiffener plates 83 and 89 are shown welded by full-penetration groove welds to the inside of flanges 78 and 84 of column 79. Although full-penetration welds are shown in this FIG. and in FIG. 21, it is to be understood that fillet welds, partial-penetration groove welds or any other suitable welds may be used, in various engineering designs of the structural joint connection.

Figure 23:
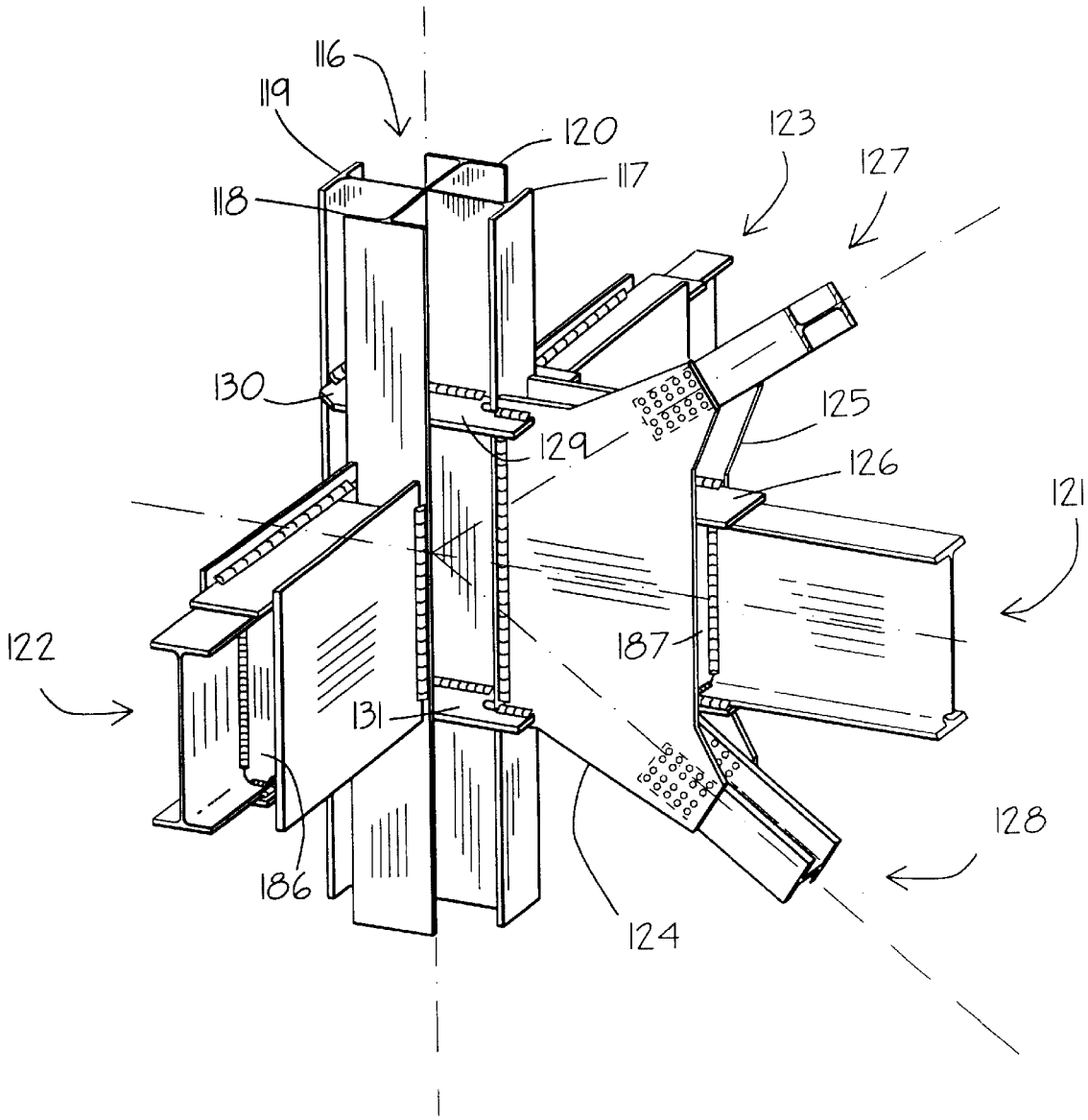
FIG. 23 is an isometric view of a multi-flanged cruciform column showing beams connected through gusset plates to the faces of three flanges of the column. Also shown are braces connected to two of such gusset plates.

FIG. 23 is an isometric view of a multi-flanged column 116 showing beams 121–123 connected through gusset plates to the faces of three flanges 117, 118 and 120 of cruciform column 116.

Alternatively, all said beams may be similarly connected with gusset plates, as shown, to a built-up box column, rather than to a cruciform column which is shown.

Flange 119 is not shown similarly connected to a beam, but, of course, it could be. Alternatively, flange 119 may be omitted altogether from the multi-flanged column 116, (which in this FIG., is cruciform in shape), leaving an asymmetrical, cruciform column with only three flanges 117, 118 and 120, which is shown and described hereafter in connection with FIG. 26A.

Also shown in FIG. 23 are braces 127 and 128 connected through gusset plates 124 and 125 to the face of column flange 117. It is noted that gusset plates 124 and 125 have extensions to accommodate receiving braces 127 and 128 and being bolted thereto, as shown. Braces 127 and 128 might, in another example, be welded to gusset plates 124 and 125 instead of being bolted thereto. Horizontal, continuity stiffener plates 129, 130 and 131 are visible, and are examples of the additional horizontal, continuity stiffener plates disposed within the multi-flanged, cruciform column 116. FIG. 26 hereafter more clearly illustrates such horizontal, continuity stiffener plates in a similar structure. Alternatively, if flange 119 was to be omitted from cruciform column 116, it is to be understood that horizontal continuity stiffener plate 130 would necessarily be reconfigured to accommodate the asymmetry of the modified cruciform column, as shown hereafter in FIG. 26A. Vertical shear plates 186 and 187, partially visible, are welded between beams 122 and 121 and their respective gusset plates, in order to carry vertical loads placed on the beams.

Alternatively, for box column applications, such continuity stiffener plates are not required.

Figure 24:
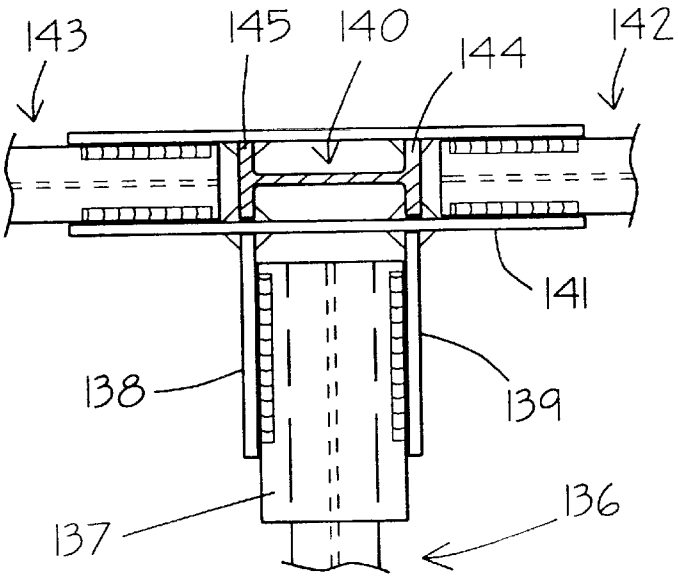
FIG. 24 is a plan view showing a beam flange connected through a wide cover plate and thence through two parallel gusset plates to a column, through an additional, orthogonal gusset plate which extends along the sides of two additional beams, parallel to the column web. The gusset plates attached to the wide cover plate are congruent with the ends of the flanges of the column although separated therefrom by a long gusset plate.

FIG. 24 is a plan view showing a beam 136 connected through a wide cover plate 137 and gusset plates 138 and 139 to a column 140 through an additional, orthogonal gusset plate 141 which extends along the sides of two additional beams 142 and 143. The gusset plates 138 and 139 attached to the wide cover plate 137 are in alignment with the flanges 144 and 145 of the column 140 although separated therefrom by the long, orthogonal gusset plate 141. The welds shown are all fillet welds, although full-penetration groove welds, partial-penetration groove welds or any other suitable welds might be used.

Figure 25:
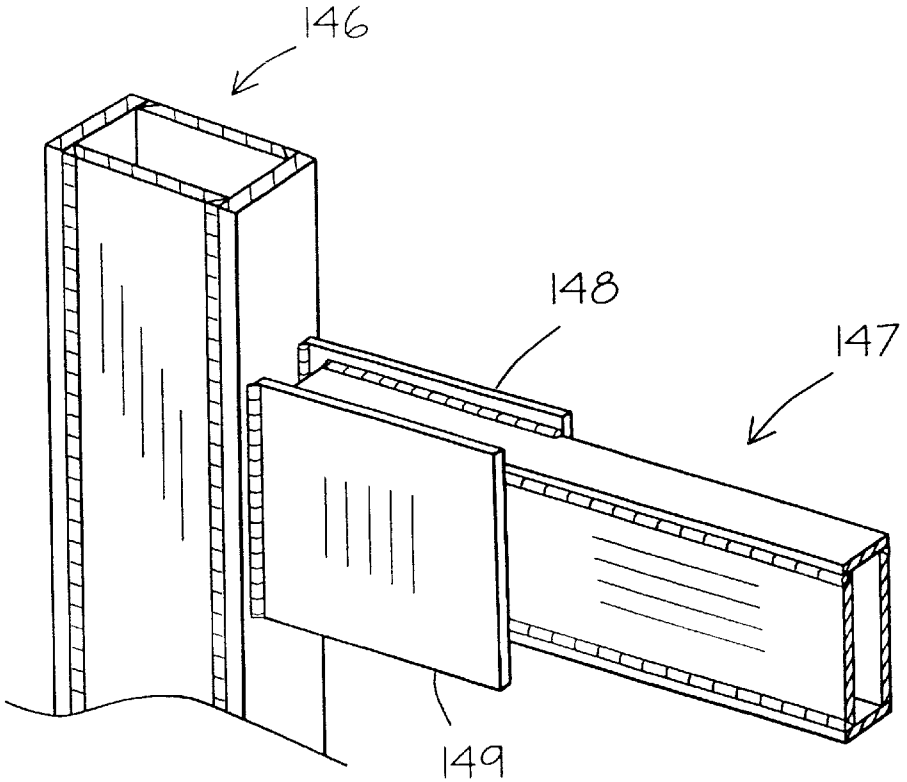
FIG. 25 illustrates a box beam connected to a box column through gusset plates.

FIG. 25 illustrates a box beam 147 connected to a box column 146 through gusset plates 148 and 149 by fillet welds. Full-penetration groove welds, partial-penetration groove welds or any other suitable welds might also be used in such circumstances. If the box beam 147 has rounded corners, as has a tube beam, various other weld forms might be used, particularly, a weld sometimes used by those skilled in the art, which weld is known as flare-bevel groove weld, between the gusset plates 148 and 149 and the tube beam. It is one of the "suitable welds" referred to herein, and is used commonly in situations in which the gap, to be filled with weld material, is curved on one or both sides.

It is noted that the box beam 147 and box column 146 are built up of plates, by full-penetration groove welds. Alternatively, the box beam and box column could be a tube beam and a tube column, respectively.

FIG. 26 is a plan view of two beams 150 and 151 connected without cover plates to gusset plates. Beam 150 is welded to gusset plates 152 and 153 which are, in turn, welded to the flange 154 of multi-flanged, cruciform column 155. Within column 155 may be seen horizontal, continuity stiffener plates 156–159. The horizontal stiffeners 156–159 are welded within the multi-flanged, cruciform column 155 to the flanges and webs of the column. Also, it may be seen that horizontal continuity stiffener plates 156 and 159 extend outwardly along the sides of gusset plates 152 and 153, and are welded thereto. The free corners of horizontal, continuity stiffener plates 156 and 159 are shown radiused. Alternatively, they could be square corners. Beam 151 is connected in slightly different fashion to flange 160, but the joint connection may, of course, be designed to attached beam 151 in the same fashion as beam 150, to the column 155. Vertical shear plates 161 and 162 are disposed at the end of gusset plates 152 and 153, along beam 150 and are welded to those gusset plates and beam 150. As another example of possible location, vertical shear plates 163 and 164, shown in hidden lines, are disposed between the gusset plates 165 and 166 along beam 151.

The beams are shown attached to the gusset plates with longitudinal fillet welds along their flange tips. Alternatively, they can be attached using full-penetration groove welds, partial-penetration groove welds or any other suitable longitudinal welds along their flange tips.

Figure 26A:
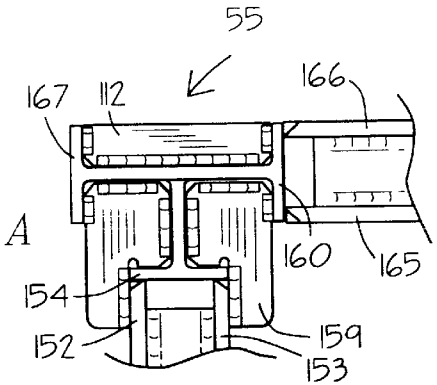
FIG. 26A is an alternate construction of a multi-flanged column, which might be used, for example, at the corner of a structure, with only two mutually orthogonal beams connected to two flanges of the column through gusset plates and horizontal, continuity stiffener plates.
Figure 26:
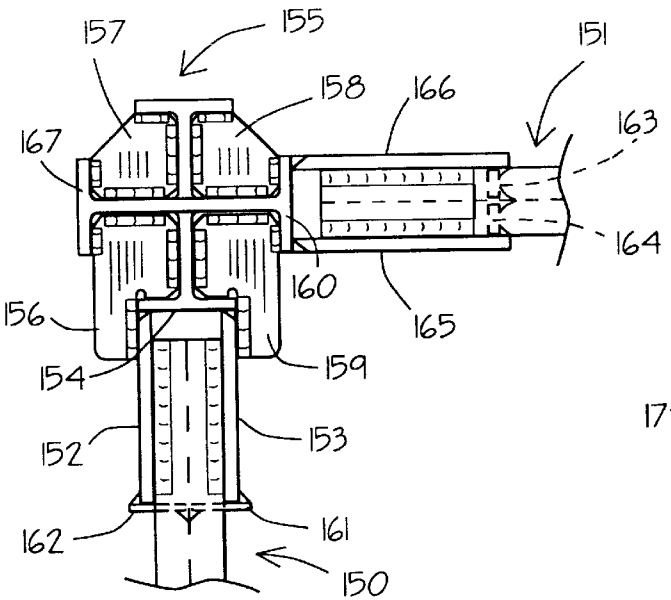
FIG. 26 is a plan view of two beams connected without cover plates to gusset plates which are, in turn, connected to the flanges of a multi-flanged column having horizontal, continuity stiffener plates.

FIG. 26A is an alternate construction of a multi-flanged column 55, which might be used, for example, at the corner of a structure, with only two mutually orthogonal beams connected to two flanges 154 and 160 of the column 55 through gusset plates 152, 153, 165 and 166 and horizontal, continuity stiffener plates such as plates 159 and 112. It is noted that horizontal, continuity stiffener plates 157 and 158, of FIG. 26 are replaced by a single horizontal, continuity stiffener plate 112 in the construction of FIG. 26A. Such horizontal, continuity stiffener plate is welded between flanges 160 and 167 of column 55 and to the web of column 55.

Figure 27:
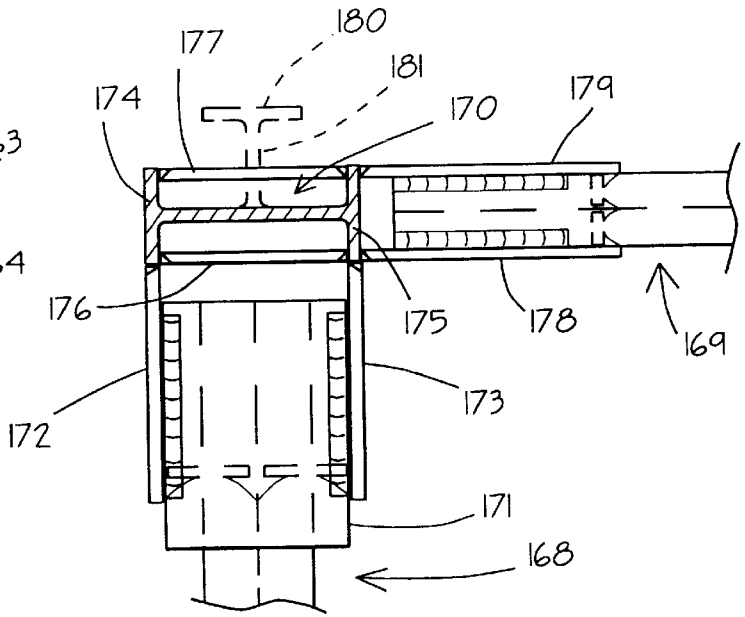
FIG. 27 is a plan view of two mutually orthogonal beams connected to a common column, in a corner two-sided configuration, using longitudinal fillet welds, one beam having cover plates and the other beam having no cover plates.

FIG. 27 is a plan view of two beams 168 and 169 connected to a column 170, using longitudinal fillet welds. The two mutually orthogonal beams 168 and 169 are mutually orthogonal and are connected to a common column 170, in a corner two-sided configuration, Beam 168 has a cover plate 171 to which it is fixedly attached and which cover plate is fillet welded to gusset plates 172 and 173. Such gusset plates are, in turn, welded to the ends of flanges 174 and 175 of column 170. Vertical, continuity stiffener plates 176 and 177 are shown extending between the flanges 174 and 175 of column 170 and are welded thereto. It is noted beam 169 is fillet welded, by longitudinal welds, directly to gusset plates 178 and 179 which are, in turn, welded by full-penetration groove welds to flange 175 of column 170.

Particular kinds of welds are illustrated although any of the fillet welds, full-penetration groove welds, partial-penetration groove welds or any other suitable welds may be used in such cases.

A third flange 180, shown in dotted lines, may be included or not, as desired, in which event vertical, continuity stiffener plate 177 would have to be divided into two parts or a slot be created in the web 181 of flange 180, to allow the vertical, continuity stiffener plate 177 to pass through.

Figure 28:
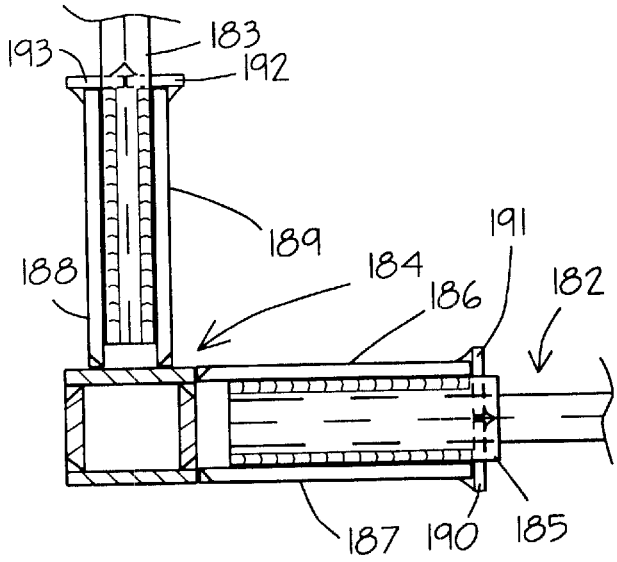
FIG. 28 is a plan view of two beams connected to a built-up box column shown in section.

FIG. 28 is a plan view of two beams 182 and 183 connected to a built-up box column 184, shown in section, which was built up using plates and full-penetration groove welds as can be seen. Cover plate 185 is welded between beam 182 and gusset plates 186 and 187. The gusset plates are welded to the extremities of the box column 184, flush with the sides of column 184. On the other hand, beam 183 is welded directly to gusset plates 188 and 189 which, in turn, are welded, by full-penetration groove welds, to column 184, somewhat inwardly from the extremities of the column 184. External, vertical shear plates 190–193 for beams 182 and 183 are shown.

Figure 29:
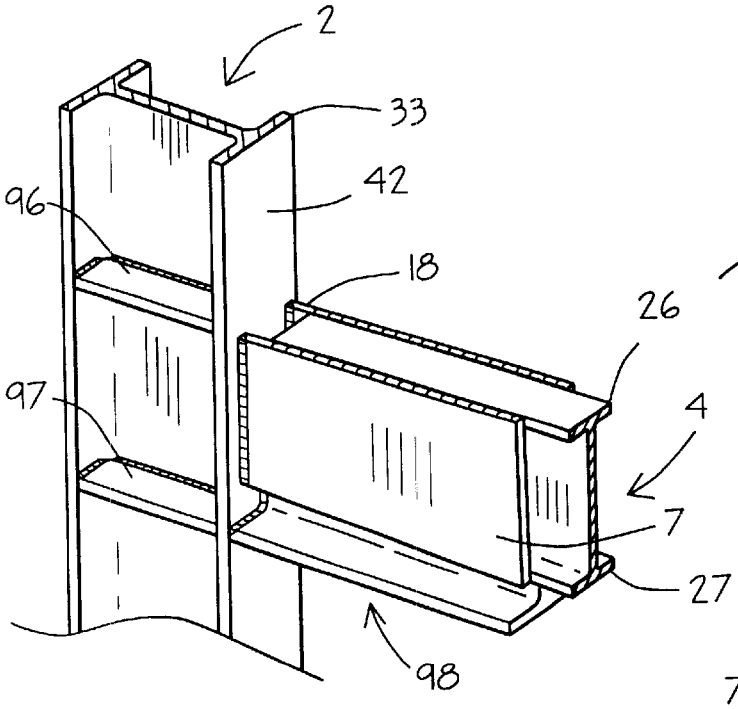
FIG. 29 is an isometric of a beam connected to a column, showing gusset plates which do not, but may, extend above or below the beam and which are welded to the beam by longitudinal, full-penetration groove welds. A haunch is seen below the beam, which haunch extends the same distance as the gusset plates away from the column. Continuity stiffener plates, are shown disposed horizontally within the column.

FIG. 29 is an isometric of a beam 4 connected to a column 2, similar to that shown in FIG. 3. FIG. 29 has gusset plates 7 and 18 which do not extend above or below beam 4, shown in section, and which gusset plates are welded to the beam 4 by longitudinal, full-penetration groove welds, but, alternatively, may be welded by longitudinal fillet welds, partial-penetration groove welds or any other suitable welds. A haunch 98 is seen below the beam 4 and horizontal, continuity stiffener plates, 96 and 97 are shown welded within the column 2. In this embodiment, continuity stiffener plate 96 lies in the same horizontal plane as the upper flange of beam 4 and continuity stiffener plate 97 lies in the same horizontal plane as the flange or lower, horizontal surface of haunch 98.

Haunch 98 provides additional stiffness to the beam-to-column connection beyond that already provided by the gusset plates 7 and 18. Haunch 98 is shown as extending the same distance as the gusset plates 7 and 18 away from column 2, but the haunch 98 may extend more or less than that shown.

It is to be understood that gusset plates 7 and 18 may also be designed to extend only slightly above and below beam 4, or well above and below beam 4, in other designs, as shown in other FIGS. herein and, also, may be welded using other welds than those shown.

Not visible are vertical shear plates which would be welded between the beam 4 and gusset plates 7 and 18, as taught previously herein.

Figure 30:
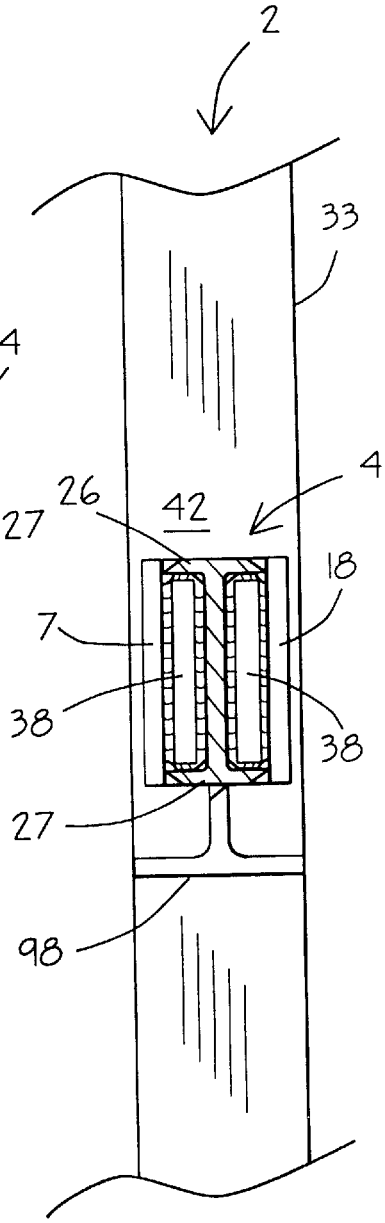
FIG. 30 is an end view of the isometric view of FIG. 29, showing the full-penetration groove welds between the beam flanges and the gusset plates. Such a weld is also shown between the web of the haunch and the bottom flange of the beam.

FIG. 30 is an end view of the isometric view of FIG. 29, showing the full-penetration groove welds between the flanges of beam 4 and the gusset plates 7 and 18. Such a weld is also shown between the web of haunch 98 and the bottom flange 27 of the beam 4. Vertical shear plates 38 are visible in this view, welded between the beam 4 and gusset plates 7 and 18.

The joint structures described herein all provide a columnar, "primary support" system for structures, and, as well, the capability of achieving strong, moment-resisting connections between beam and column, which connection can be designed to desired stiffness and ductility.

"Strong", moment-resisting connections are those connections which are designed to provide great resistance to large moments caused by forces generated by earthquakes, tornadoes, explosions and other disastrous events which place large loads on a structure.

Although specific embodiments and certain structural arrangements have been illustrated and described herein, it will be clear to those skilled in the art that various other modifications and embodiments may be made incorporating the spirit and scope of the underlying inventive concepts and that the same are not limited to the particular forms herein shown and described, except as determined by the scope of the following claims.

I claim:

1. A structural joint connection comprising, a column capable of providing columnar, primary support for a building, a tower and a similarly heavy structure, said column having at least two flanges, a beam having at least two flanges, wherein said at least two flanges of said beam have a width, two gusset plates, each having a vertical edge, both of said edges abutting one of said at least two flanges of said column, wherein said two gusset plates are disposed on opposite sides of said beam, said gusset plates being in face-to-face relationship with respect to each other and extend along the sides of said beam, wherein said two gusset plates are spaced apart at least said width of said at least two flanges of said beam, wherein said two gusset plates are fixedly attached with respect to said beam in a strong, moment-resisting connection, wherein said gusset plates are attached to said column, by said vertical edge of each said gusset plate being welded to said column flange which they abut, wherein said gusset plates do not extend a substantial distance, beyond said column flange which they abut, in a direction across said column.

2. The structural joint connection recited in claim 1, said structural joint connection further including two continuity plates welded between the flanges of said column, and wherein said continuity plates are disposed in one of horizontal position or vertical position within said column.

3. The structural joint connection recited in claim 1, wherein said gusset plates are fixedly attached with respect to said beam in a strong, moment-resisting connection, at least in part, by being welded to said beam.

4. The structural joint connection recited in claim 1 said structural joint connection further including two or more stiffener plates welded within said column at or near the location said gusset plates are welded to said column, strengthening said column at said location.

5. The structural joint connection recited in claim 4 wherein said stiffener plates extend in the longitudinal direction of said column.

6. The structural joint connection recited in claim 4 wherein said stiffener plates extend perpendicular to the longitudinal direction of said column.

7. A structural joint connection comprising, a column capable of providing columnar, primary support for a building, a tower and a similarly heavy structure, said column having at least two flanges, a beam having at least two flanges, two gusset plates, each having a vertical edge which abuts one of said at least two flanges of said column, wherein said two gusset plates are disposed on opposite sides of said beam, said gusset plates being in face-to-face relationship with respect to each other and extending along the sides of said beam, wherein said two gusset plates are fixedly attached with respect to said beam in a strong, moment-resisting connection, wherein said gusset plates are attached to said column, by said vertical edge of each said gusset plate being welded to said column flange which they abut, wherein said gusset plates do not extend a substantial distance beyond said column flange, which they abut, in a direction across said column, wherein said beam has a web interconnecting said flanges of said beam, said structural joint connection further including two vertical shear plates, wherein said two vertical shear plates are disposed on opposite sides of said web from each other, and wherein said vertical shear plates are welded between said gusset plates and said beam, at or near the end of said gusset plates farthest away from said column and along said beam.

8. The structural joint connection recited in claim 7, wherein gusset plates are welded to said beam along the longitudinal direction of said beam, for substantially the distance said gusset plates extend along the sides of said beam.

9. A structural joint connection comprising, a column capable of providing columnar, primary support for a building, a tower and a similarly heavy structure, said column having at least two flanges, a beam having at least two flanges, two gusset plates, each having a vertical edge, both of said edges abutting one of said at least two flanges of said column, wherein said two gusset plates are disposed on opposite sides of said beam, said gusset plates being in face-to-face relationship with respect to each other and extending along the sides of said beam, wherein said two gusset plates are fixedly attached with respect to said beam in a strong, moment-resisting connection, and wherein said gusset plates are attached to said column, by said vertical edge of each said gusset plate being welded to said column flange which they abut, wherein said gusset plates do not extend a substantial distance beyond said column flange, which they abut, in a direction across said column, wherein said gusset plates are fixedly attached with respect to said beam by a cover plate disposed on the top of said beam and a cover plate disposed on the bottom of said beam, said cover plates being disposed between said gusset plates, wherein said cover plates are fixedly attached to said beam for a distance extending from substantially the same, or slightly more than, the distance said gusset plates extend along said beam, and wherein said cover plates are welded to said gusset plates.

10. A structural joint connection comprising, a column of sufficient size and strength to provide columnar support for buildings, towers and similarly heavy structures, said column having at least two flanges, wherein each said flange has a face, a first beam of sufficient size and strength to provide support for a floor of said buildings, towers and similarly heavy structures, said first beam having one end disposed near said column, said beam having a width, a pair of gusset plates, wherein said gusset plates are spaced apart at least said width of said beam, wherein said gusset plates extend along opposite sides of said first beam in face-to-face, parallel relationship with respect to each other, wherein said gusset plates are fixedly attached with respect to said first beam, wherein both said gusset plates terminate at or near the face of one of said at least two flanges of said column, wherein said gusset plates do not extend a substantial distance, beyond said face of said column flange at which they terminate, in a direction across said column, and wherein said gusset plates are attached to said face by welds, said welds extending along the longitudinal direction of said column.

11. The structural joint connection recited in claim 10 said structural joint connection further including a second beam, said second beam having a width, said structural joint connection further including a second pair of gusset plates extending along opposite sides of said second beam in parallel, face-to-face relationship with respect to each other, wherein said second pair of gusset plates are fixedly attached with respect to said second beam, said second pair of gusset plates being spaced apart at least said width of said second beam, wherein both gusset plates of said second pair of gusset plates terminate at or near the face of a second flange of said at least two flanges of said column, wherein said second pair of gusset plates are attached to said face of said second flange of said column, by welds, said welds extending along the longitudinal direction of said column, and wherein said second pair of gusset plates do not extend a substantial distance, beyond said second face of said second flange of said column at which they terminate, in a direction across said column.

12. A structural joint connection comprising, a column adapted for use as permanent, columnar support for buildings, towers and similarly heavy structures, said column having at least two flanges, a beam having at least two flanges, said flanges having a width, a pair of gusset plates in parallel, face-to-face relationship with respect to each other, said gusset plates being disposed on opposite sides of said beam and extending along the flanges of said beam, wherein said gusset plates are disposed apart said width of said flanges of said beam or a greater width, wherein said beam is fixedly attached with respect to said parallel gusset plates in a strong, moment-resisting connection, wherein both said gusset plates abut one of said at least two flanges of said column, wherein each said parallel gusset plate is welded along an end thereof to said one of said at least two flanges of said column, wherein said parallel gusset plates do not extend a substantial distance beyond said one flange in a direction away from said beam, wherein no additional gusset plate is attached to said column and the end of either of said parallel gusset plates, in the same plane as said parallel gusset plates.

13. The structural joint connection recited in claim 12 wherein each said parallel gusset plate is welded along an end thereof to said one flange of said column, by being welded to the end of said one flange of said column.

14. The structural joint connection recited in claim 12 wherein each said parallel gusset plate is welded along an end thereof to said one flange of said column, by being welded to the face of said one flange of said column.

15. The structural joint connection recited in claim 12 wherein each said parallel gusset plate is welded to the face of said one flange of said column, at a location inwardly from the outer edge of said one flange of said column.

16. The structural joint connection recited in claim 12 wherein is included, two vertical shear plates disposed on opposite sides of said beam from each other and fixedly attached to said beam and said gusset plates, and wherein said vertical shear plates are disposed at or near the end of said gusset plates along said beam, away from said column.

17. In combination, a column for providing columnar support for a building and similarly heavy structure, said column having at least one face, a beam, said beam having a width, two parallel gusset plates, in face-to-face relationship, and extending along opposite sides of said beam, and fixedly attached with respect to said beam in a strong, moment-resisting connection, wherein said two parallel gusset plates are both welded to said at least one face of said column in a strong, moment-resisting connection, and wherein said two parallel gusset plates terminate at or near said at least one face of said column, near said beam.

18. The combination recited in claim 17, wherein said face of said column has vertical, outer edges, wherein said gusset plates are welded to said one face of said column, at a location inwardly from said vertical, outer edges of said one face of said column.

19. In combination, a column for providing columnar support for a building, a tower and similarly heavy structure, said column having at least one face, a beam, two parallel gusset plates, in face-to-face relationship, and extending along opposite sides of said beam, and fixedly attached with respect to said beam in a strong, moment-resisting connection, wherein said two parallel gusset plates terminate at or near said at least one face of said column, near said beam, wherein is included at least two vertical shear plates, and wherein said gusset plates are fixedly attached with respect to said beam, in part by said at least two vertical shear plates, one welded between said beam and one of said gusset plates and the other welded between said beam and the other of said gusset plates.

20. The combination recited in claim 19, wherein two of said at least two vertical shear plates are disposed at or near the end of said gusset plates away from said column.

21. The combination recited in claim 19, wherein said beam has a bottom flange, and wherein said a haunch is disposed beneath said beam and fixedly attached to said at least one face of said column and said bottom flange of said beam.

* * * * *